US011149735B2

(12) United States Patent
DeFord et al.

(10) Patent No.: US 11,149,735 B2
(45) Date of Patent: Oct. 19, 2021

(54) POLYMERIC COMPOSITE INSERT COMPONENT FOR A SCROLL COMPRESSOR

(71) Applicant: Emerson Climate Technologies, Inc., Sidney, OH (US)

(72) Inventors: Jack Morris DeFord, Casstown, OH (US); Charles Penzone Dagenfield, Maplewood, OH (US); Steven Baker, Sidney, OH (US); Yogesh Sudhirarao Mahure, Pune (IN)

(73) Assignee: Emerson Climate Technologies, Inc., Sidney, OH (US)

( * ) Notice: Subject to any disclaimer, the term of this patent is extended or adjusted under 35 U.S.C. 154(b) by 223 days.

(21) Appl. No.: 16/435,033

(22) Filed: Jun. 7, 2019

(65) Prior Publication Data

US 2019/0323504 A1 Oct. 24, 2019

Related U.S. Application Data

(63) Continuation-in-part of application No. 16/210,503, filed on Dec. 5, 2018.
(Continued)

(30) Foreign Application Priority Data

Dec. 8, 2018 (IN) ..... 201821046511

(51) Int. Cl.
*F04C 27/00* (2006.01)
*F01C 19/00* (2006.01)
*F04C 18/02* (2006.01)

(52) U.S. Cl.
CPC ..... *F04C 27/005* (2013.01); *F01C 19/005* (2013.01); *F04C 18/0215* (2013.01);
(Continued)

(58) Field of Classification Search
CPC ..... F04C 18/0215; F04C 2230/60; F04C 27/005; F04C 27/008; F05C 2225/12
See application file for complete search history.

(56) References Cited

U.S. PATENT DOCUMENTS 5,741,120 A 4/1998 Bass et al.
5,803,716 A * 9/1998 Wallis ..... F04C 18/0215 417/310
(Continued)

FOREIGN PATENT DOCUMENTS

CN 1137614 A 12/1996
CN 103189654 A 7/2013
(Continued)

OTHER PUBLICATIONS

First Office Action for Chinese Patent Application No. 2018115252770 dated Jan. 6, 2020 with English language summary provided by Unitalen Attorneys at Law, 24 pages.

*Primary Examiner* — Mary Davis
(74) *Attorney, Agent, or Firm* — Harness, Dickey & Pierce, P.L.C.

(57) ABSTRACT

An insert component for a scroll compressor comprises a polymer and at least one reinforcing or lubricating particle. The insert component comprises an annular body and an axial projection. The annular body defines a first centrally-disposed opening having has a central axis extending therethrough. The annular body has a first side comprising a first contact surface configured to engage a partition plate and a second side a second contact surface configured to engage a floating seal assembly. The first contact surface defines a slope between first and second radial locations. The axial projection extends from the annular body and can be received in a second centrally-disposed opening of the partition plate. The insert component can fluidly seal both a first interface between the first contact surface and the
(Continued)

partition plate and a second interface between the second contact surface and a floating seal assembly during operation of the scroll compressor.

20 Claims, 14 Drawing Sheets

Related U.S. Application Data

(60) Provisional application No. 62/598,217, filed on Dec. 13, 2017.

(52) U.S. Cl.
CPC ..... *F05B 2280/4005* (2013.01); *F05B 2280/4006* (2013.01); *F05B 2280/4009* (2013.01); *F05B 2280/6003* (2013.01)

(56) References Cited

U.S. PATENT DOCUMENTS

| | | | |
|---|---|---|---|
| 8,932,036 | B2 | 1/2015 | Monnier et al. |
| 9,121,276 | B2 | 9/2015 | Heidecker et al. |
| 9,347,343 | B2 | 5/2016 | Zoppi et al. |
| 9,638,191 | B2 | 5/2017 | Stover |
| 2019/0017850 | A1 | 1/2019 | Bradbury et al. |

FOREIGN PATENT DOCUMENTS

| | | | |
|---|---|---|---|
| CN | 104612851 | A | 5/2015 |
| CN | 104662300 | A | 5/2015 |
| CN | 106662104 | A | 5/2017 |
| CN | 209654237 | U | 11/2019 |

* cited by examiner

POLYMERIC COMPOSITE INSERT COMPONENT FOR A SCROLL COMPRESSOR

CROSS-REFERENCE TO RELATED APPLICATIONS

This application is a continuation-in-part of U.S. Non-Provisional patent application Ser. No. 16/210,503 filed on Dec. 5, 2018 that claims priority to U.S. Provisional Patent Application No. 62/598,217, filed on Dec. 13, 2017. This application also claims the benefit and priority of Indian Application No. 201821046511, filed Dec. 8, 2018. The entire disclosures of each of the above applications are incorporated herein by reference.

FIELD

The present disclosure relates to polymeric composite insert components for compressors and more specifically, to polymeric composite insert component designs for providing a fluidic seal between a partition and a floating seal assembly in a scroll compressor, and methods of assembling the polymeric composite insert component to a scroll compressor.

BACKGROUND

This section provides background information related to the present disclosure which is not necessarily prior art.

Scroll machines in general, and particularly scroll compressors, are often disposed in a hermetic shell that defines a chamber within which a working fluid is disposed. A partition within the shell often divides the chamber into a discharge pressure zone and a suction pressure zone. In a low-side arrangement, a scroll assembly is located within the suction pressure zone for compressing the working fluid. Generally, these scroll assemblies incorporate a pair of intermeshed spiral involute portions, one or both of which orbit relative to the other, so as to define one or more moving chambers which progressively decrease in size as they travel from an outer suction port towards a central discharge port. An electric motor is normally provided which operates to cause this relative orbital movement.

The partition within the shell allows compressed fluid exiting the central discharge port of the scroll assembly to enter the discharge pressure zone within the shell, while simultaneously maintaining the integrity between the discharge pressure zone and the suction pressure zone. The partition normally includes a seal, such as a floating seal assembly. The seal interacts with the partition and with the scroll member defining the central discharge port, so as to maintain a pressure differential within the compressor. Conventional air conditioning scroll compressors typically rely upon the floating seal package's ability to form a metal-to-metal face seal with a portion of the partition, such as a partition plate (e.g., muffler plate) or the shell, during compressor operation. This sealing interface provides separation of the high pressure side and low pressure side of the compressor. It is important to maintain a fluid seal between the floating seal assembly and the partition plate during operation of the compressor. However, the components at the sealing interface may have potential issues with maintaining sealing conditions under all compressor operating conditions and further many suffer from excessive wear that may cause loss of sealing capabilities. The present teachings provide a polymeric composite insert component having improved sealing capability.

SUMMARY

This section provides a general summary of the disclosure, and is not a comprehensive disclosure of its full scope or all of its features.

In various aspects, the present disclosure provides a polymeric composite insert component for a scroll compressor. The polymeric composite insert component comprises a polymer and at least one reinforcing or lubricating particle. The polymeric composite insert component comprises an annular body and an axial projection. The annular body comprises a first annular inner surface. The first annular inner surface defines a first centrally-disposed opening. The first centrally-disposed opening has a central axis extending therethrough. The annular body has a first side and a second side opposite the first side. The first side comprises a first contact surface configured to engage a partition plate. The second side comprises a second contact surface configured to engage a floating seal assembly. The axial projection extends from the first side of the annular body. The axial projection is configured to engage the partition plate. The polymeric composite insert component is configured to fluidly seal both a first interface and a second interface during operation of the scroll compressor. The first interface is defined between the first contact surface and the partition plate. The second interface is defined between the second contact surface and the floating seal assembly.

In various aspects, the present disclosure provides a scroll compressor comprising a polymeric composite insert component, a partition plate, and a floating seal assembly. The polymeric composite insert component comprises a polymer and at least one reinforcing or lubricating particle. The polymeric composite insert component comprises an annular body and an axial projection. The annular body has a first annular inner surface defining a first centrally-disposed opening. The first centrally-disposed opening has a central axis extending therethrough. The axial projection extends from the annular body. The partition plate comprises a second centrally-disposed opening. The second centrally-disposed opening is aligned with the first centrally-disposed opening with respect to the central axis. The floating seal assembly has a third centrally-disposed opening. The third centrally-disposed opening is aligned with the first centrally-disposed opening and the second centrally-disposed opening with respect to the central axis. The polymeric composite insert component is disposed between the partition plate and the floating seal assembly. The polymeric composite insert component is configured to fluidly seal both a first interface and a second interface during operation of the scroll compressor. The first interface is defined between the polymeric composite insert component and the partition plate. The second interface defined between the polymeric composite insert component and the floating seal assembly.

In various aspects, the present disclosure provides a method of assembling a scroll compressor. The method includes aligning a first centrally-disposed opening of a polymeric composite insert component with a second centrally-disposed opening of a partition plate along a central axis. The polymeric composite insert component comprises a polymer and at least one reinforcing or lubricating particle. The polymeric composite insert component defines an annular body comprising the first centrally-disposed opening having the central axis extending therethrough. The method further includes orienting a plurality of circumferentially-disposed tabs on the polymeric composite insert component toward the partition plate. Each respective circumferentially-disposed tab of the plurality projects axially from a side of the annular body. Each respective circumferentially-disposed tab of the plurality comprises a fixed end connected to the annular body, a free end opposite the fixed end, an arm extending between the fixed end and the free end, and a radially-outwardly extending lip disposed at the free end. The method further includes contacting a sloped surface of the free end of the lip of each respective circumferentially-disposed tab with the partition plate. The method further includes translating the polymeric composite insert component toward the partition plate and causing the lips of the respective circumferentially-disposed tabs of the plurality to deflect radially inwardly until the lips snap radially outwardly and engage the partition plate to retain the polymeric composite insert component on the partition plate. A surface defined by the side of the annular body engages the partition plate. The polymeric composite insert component is configured to fluidly seal an interface defined between the surface and the partition plate during operation of the scroll compressor.

In various aspects, the present disclosure provides a polymeric composite insert component for a scroll compressor. The polymeric composite insert component comprises a polymer and at least one reinforcing or lubricating particle. The polymeric composite insert component comprises an annular body and an axial projection. The annular body comprises a first annular inner surface. The first annular inner surface defines a first centrally-disposed opening that has a central axis extending therethrough. The annular body has a first side and a second side opposite the first side. The first side comprises a first contact surface configured to engage a partition plate. The second side comprises a second contact surface configured to engage a floating seal assembly. The first contact surface defines a slope between a first radial location and a second radial location. The axial projection extends from the annular body. The axial projection is configured to be received in a second centrally-disposed opening of the partition plate. The polymeric composite insert component is configured to fluidly seal both a first interface and a second interface during operation of the scroll compressor. The first interface is defined between the first contact surface and the partition plate. The second interface is defined between the second contact surface and a floating seal assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 4A:
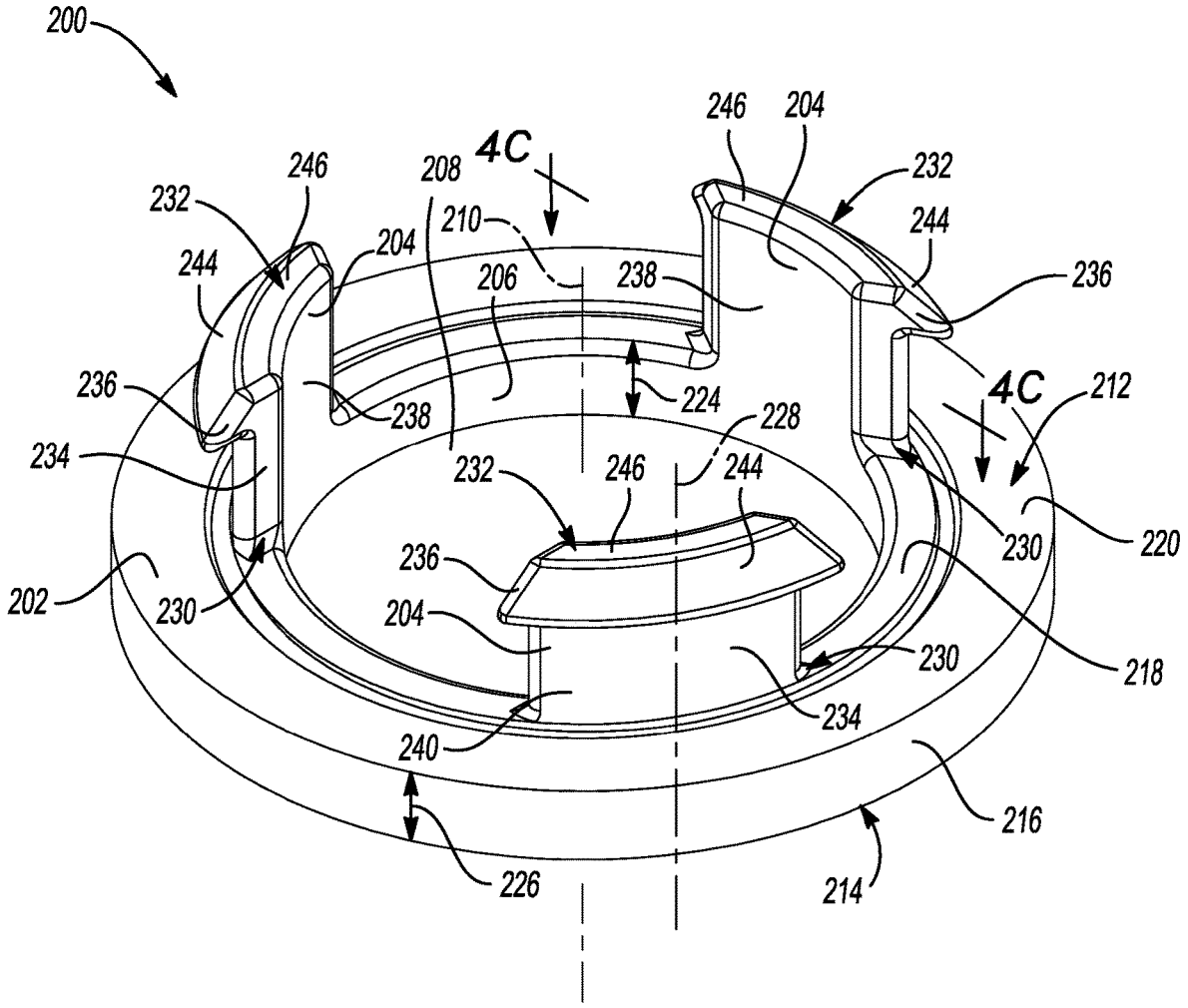
Figure 4B:
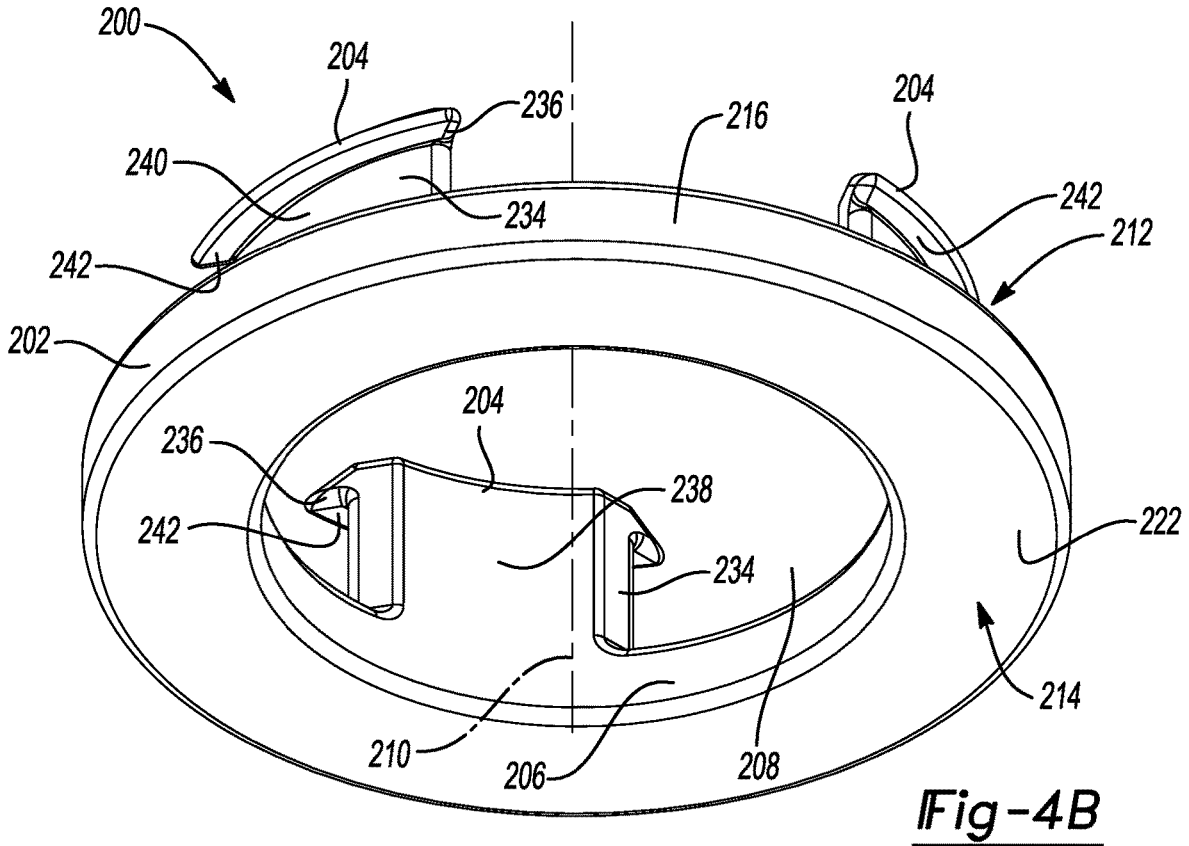
Figure 4C:
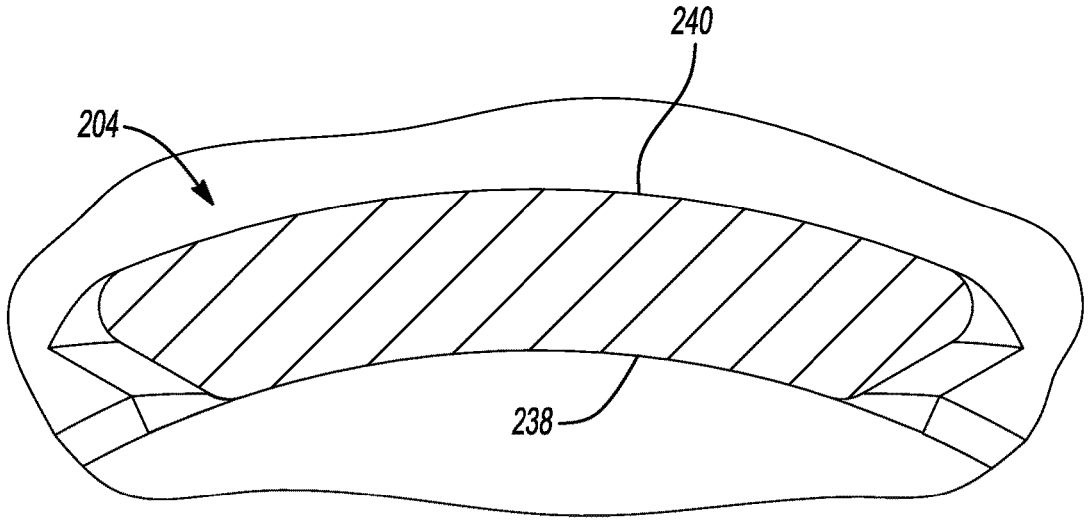
Figure 5A:
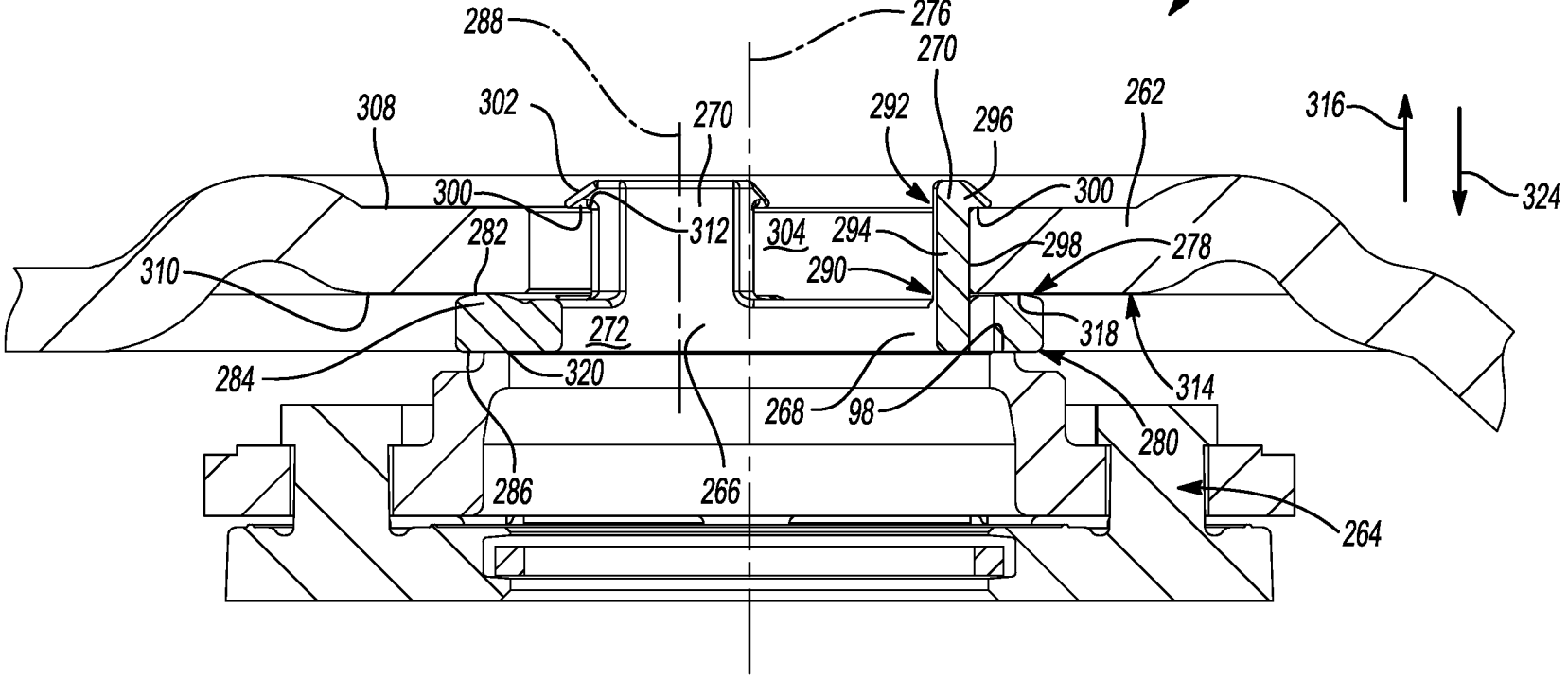
Figure 5B:
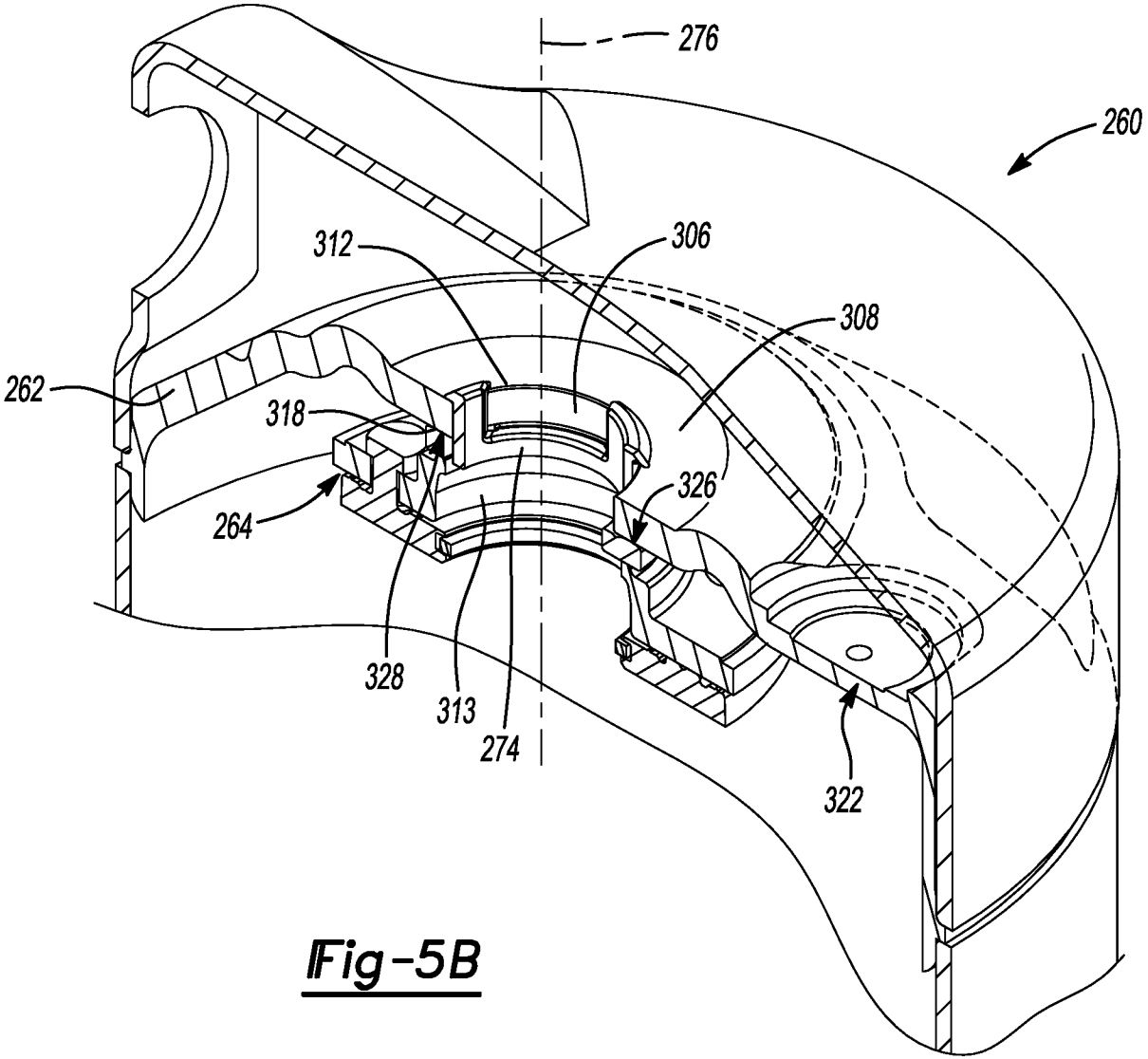
Figure 6A:
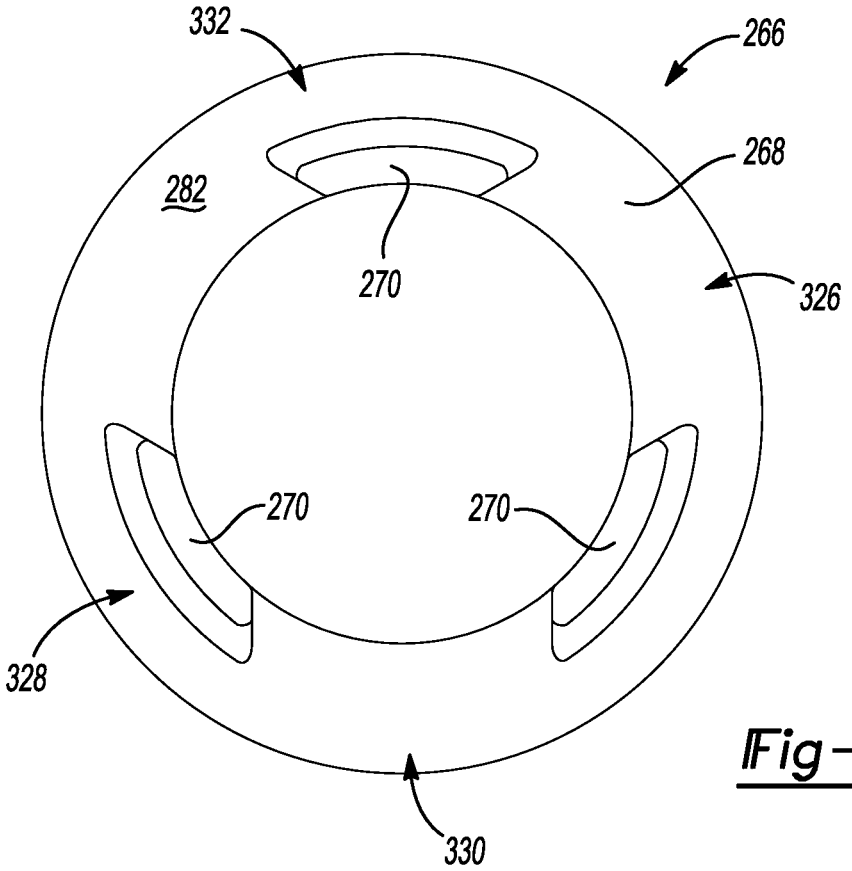
Figure 6B:
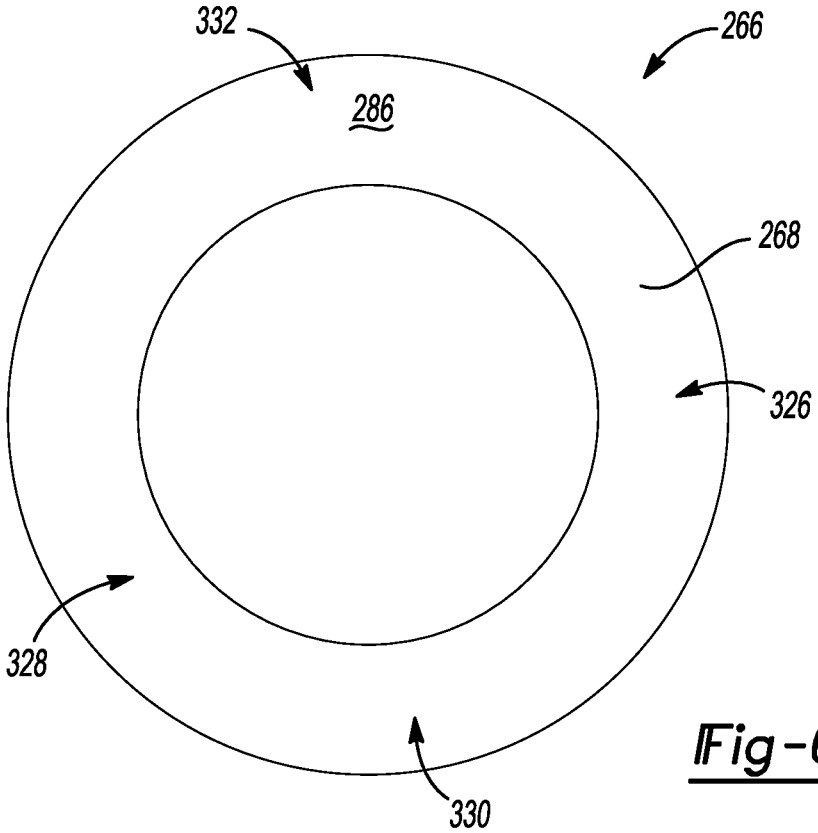
Figure 7:
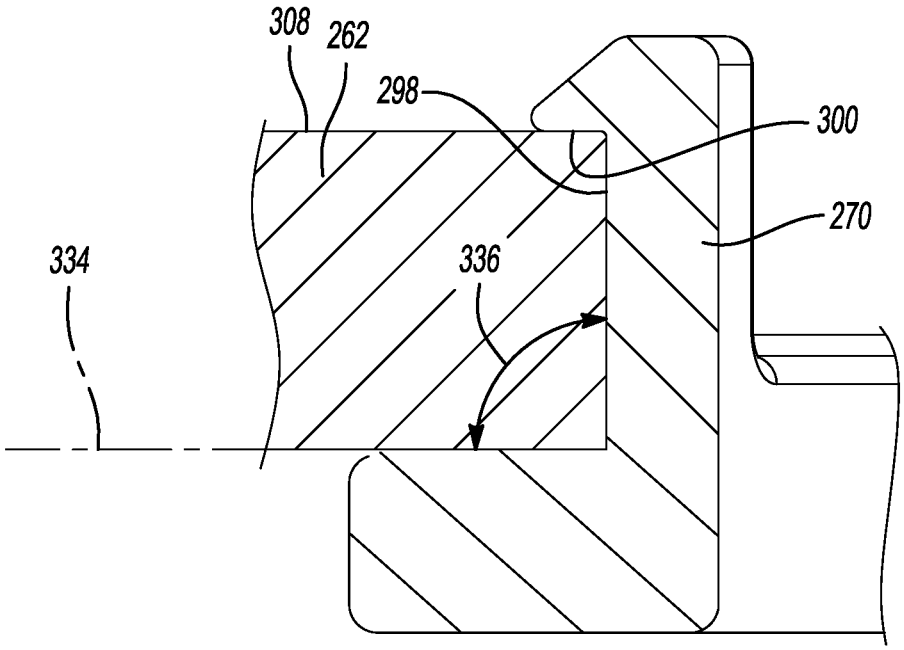
Figure 8:
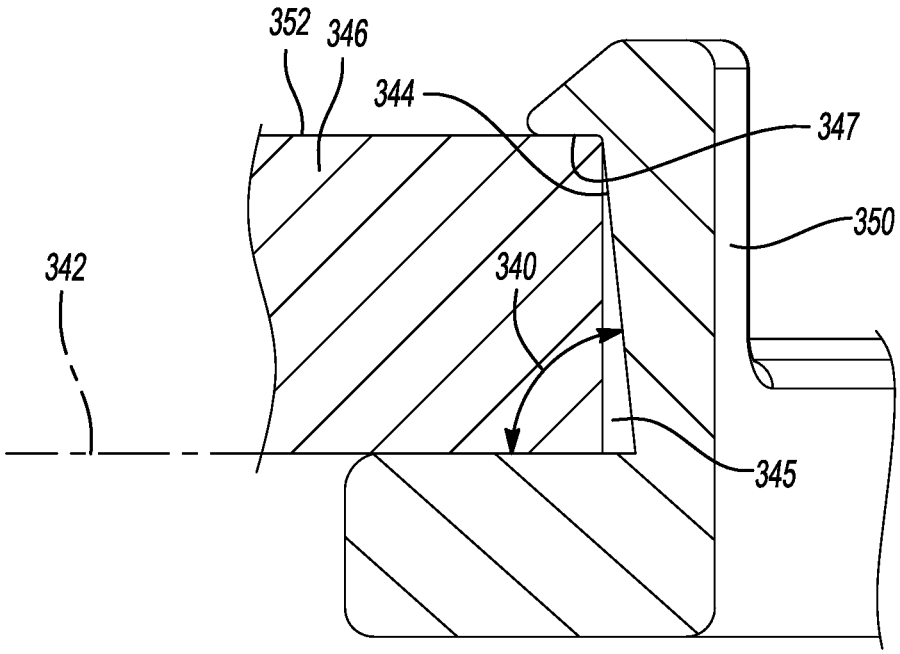
Figure 9A:
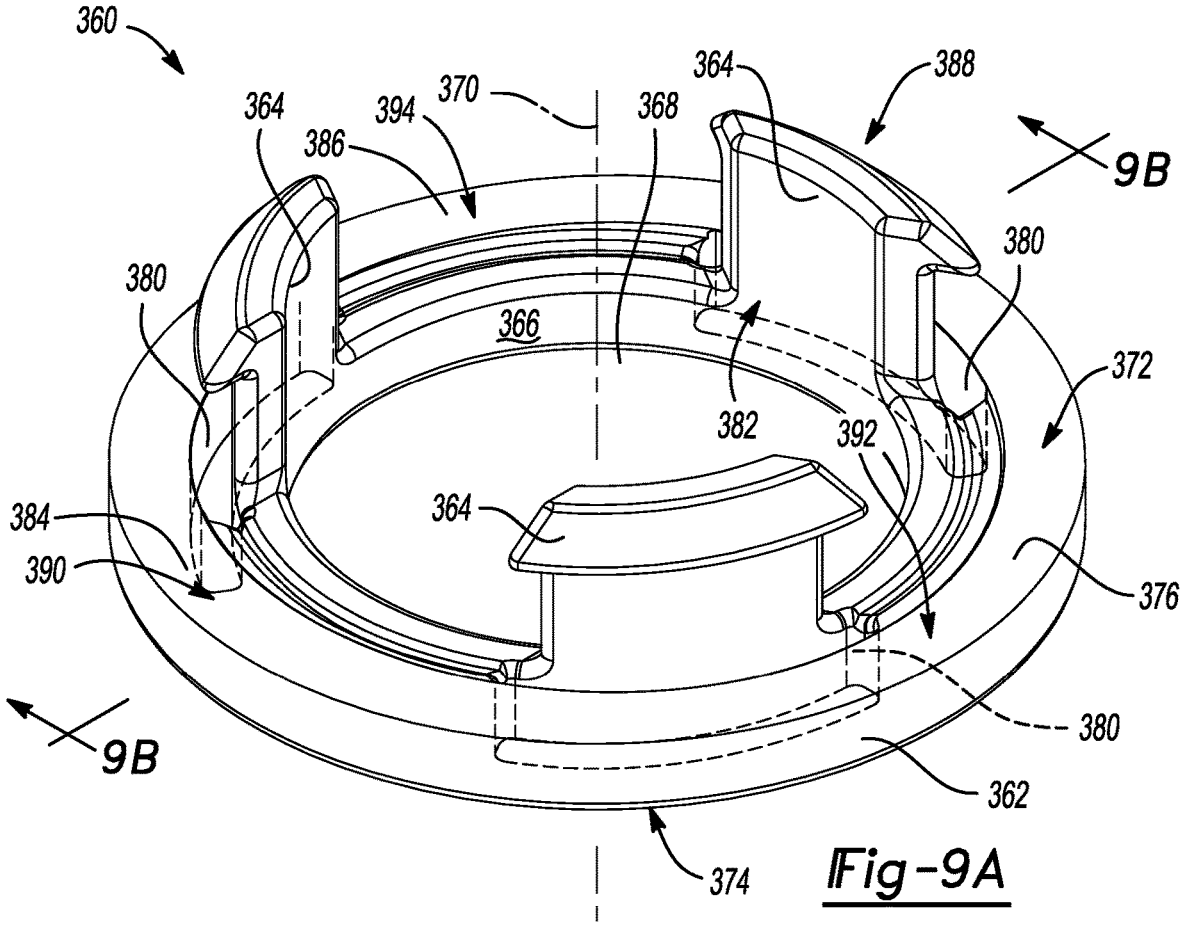
Figure 9B:
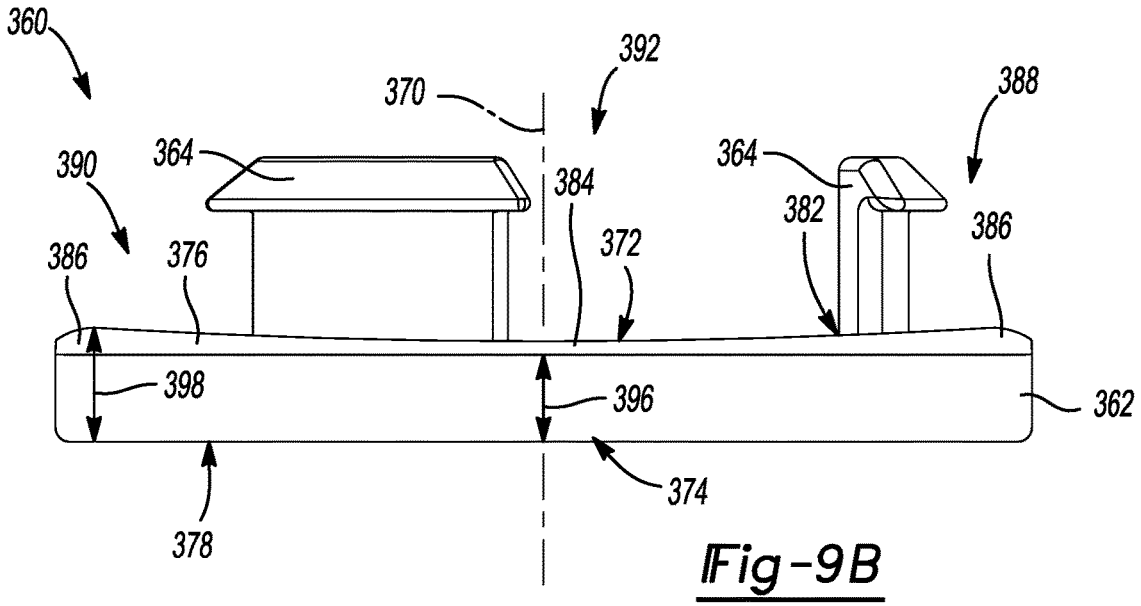
Figure 10A:
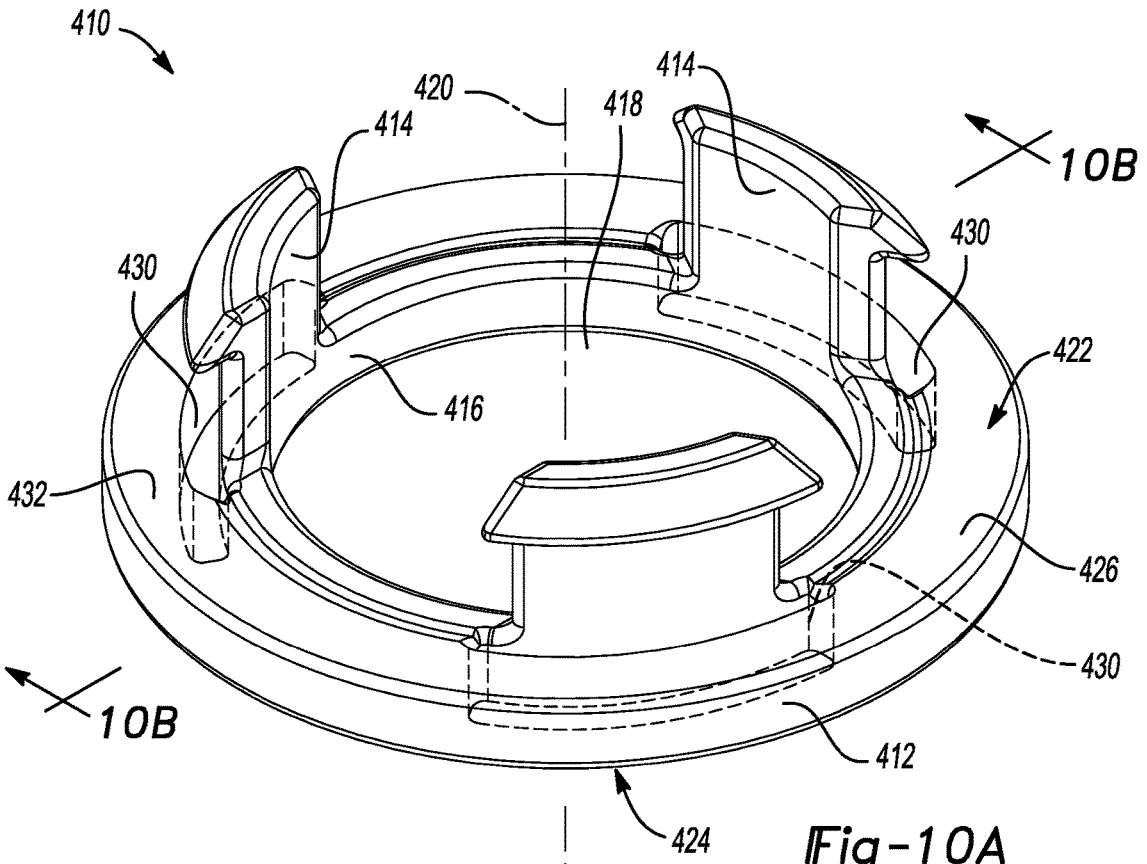
Figure 10B:
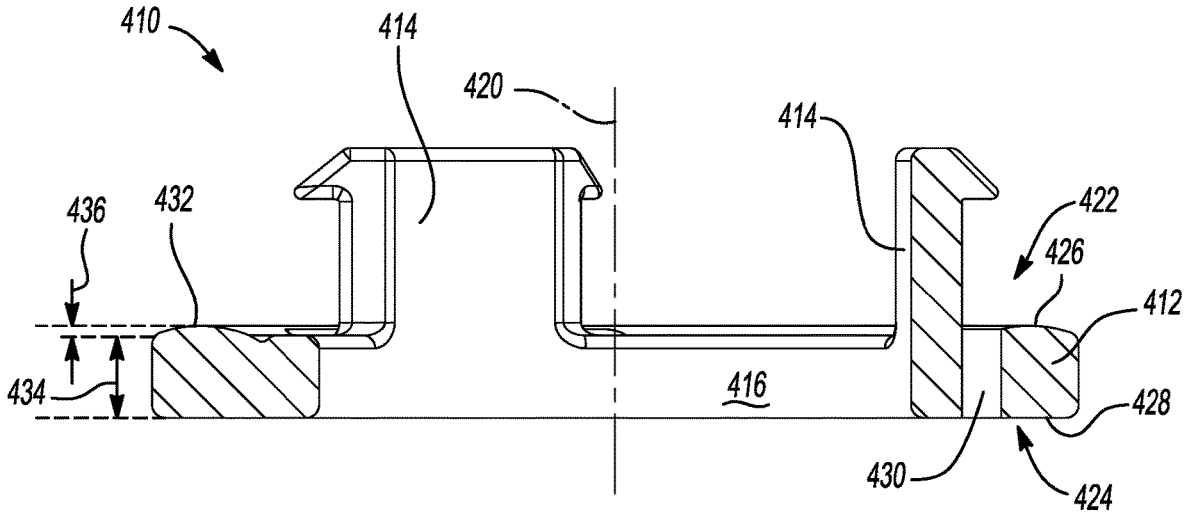
Figure 11A:
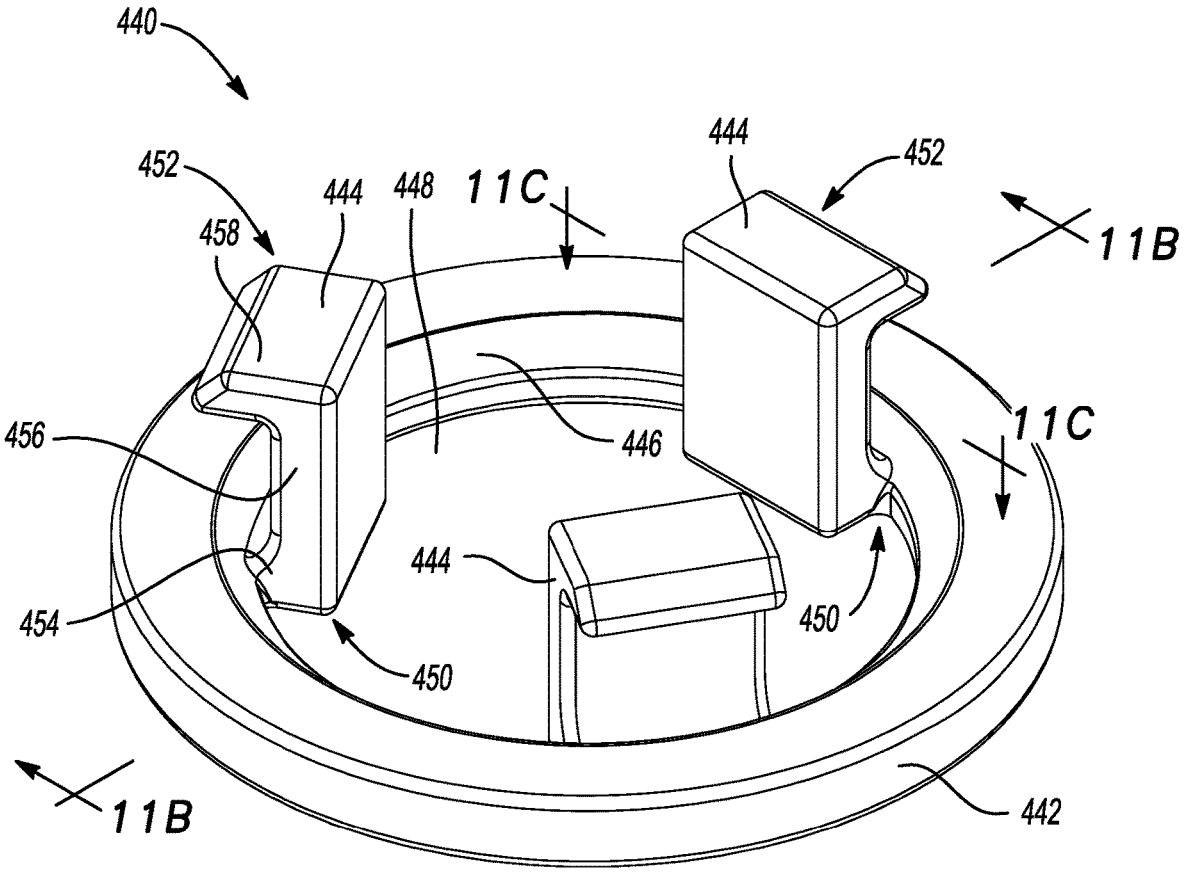
Figure 11B:
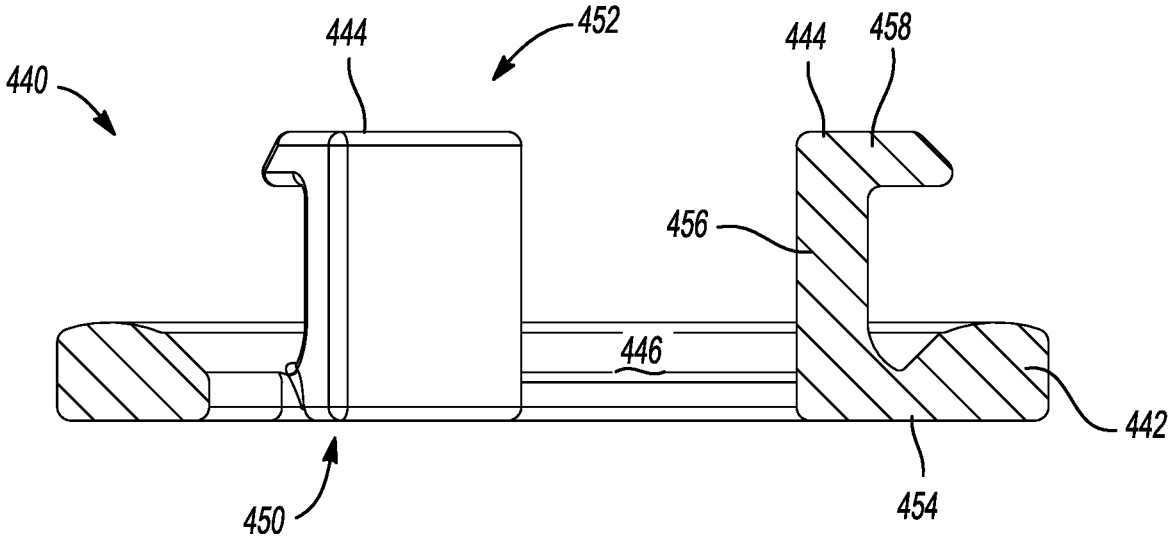
Figure 11C:
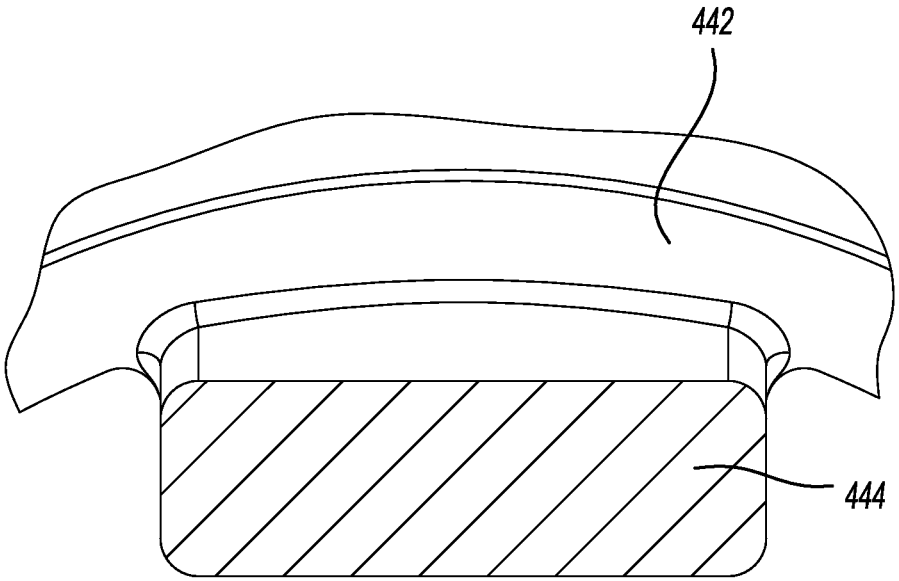
Figure 12A:
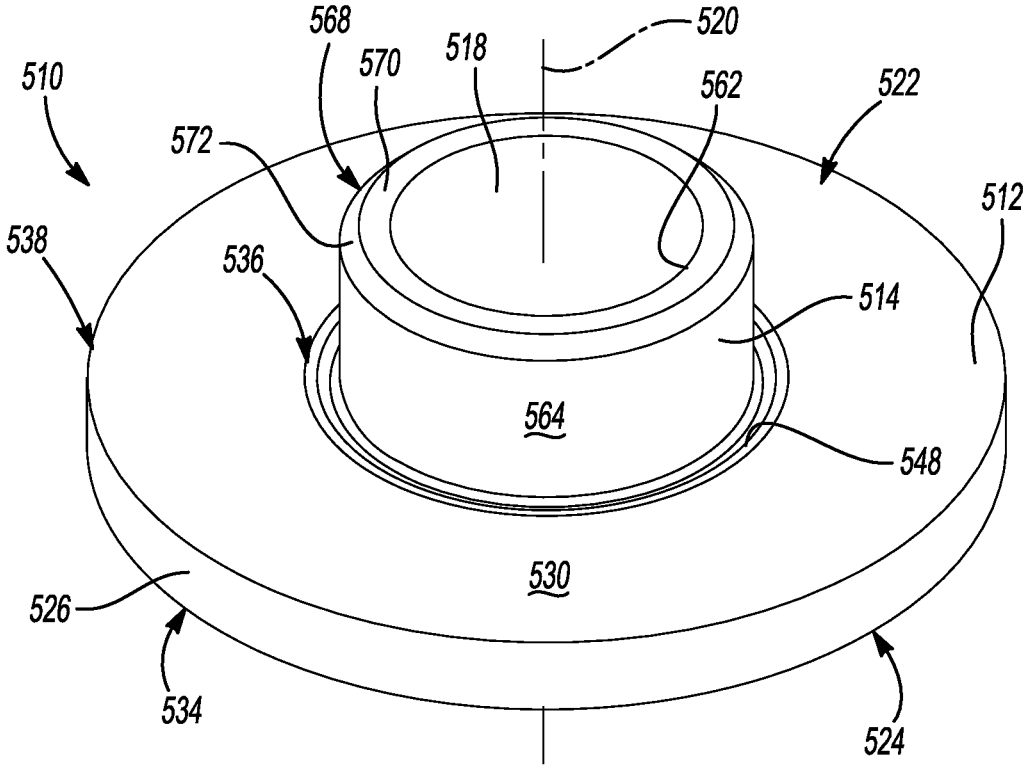
Figure 12B:
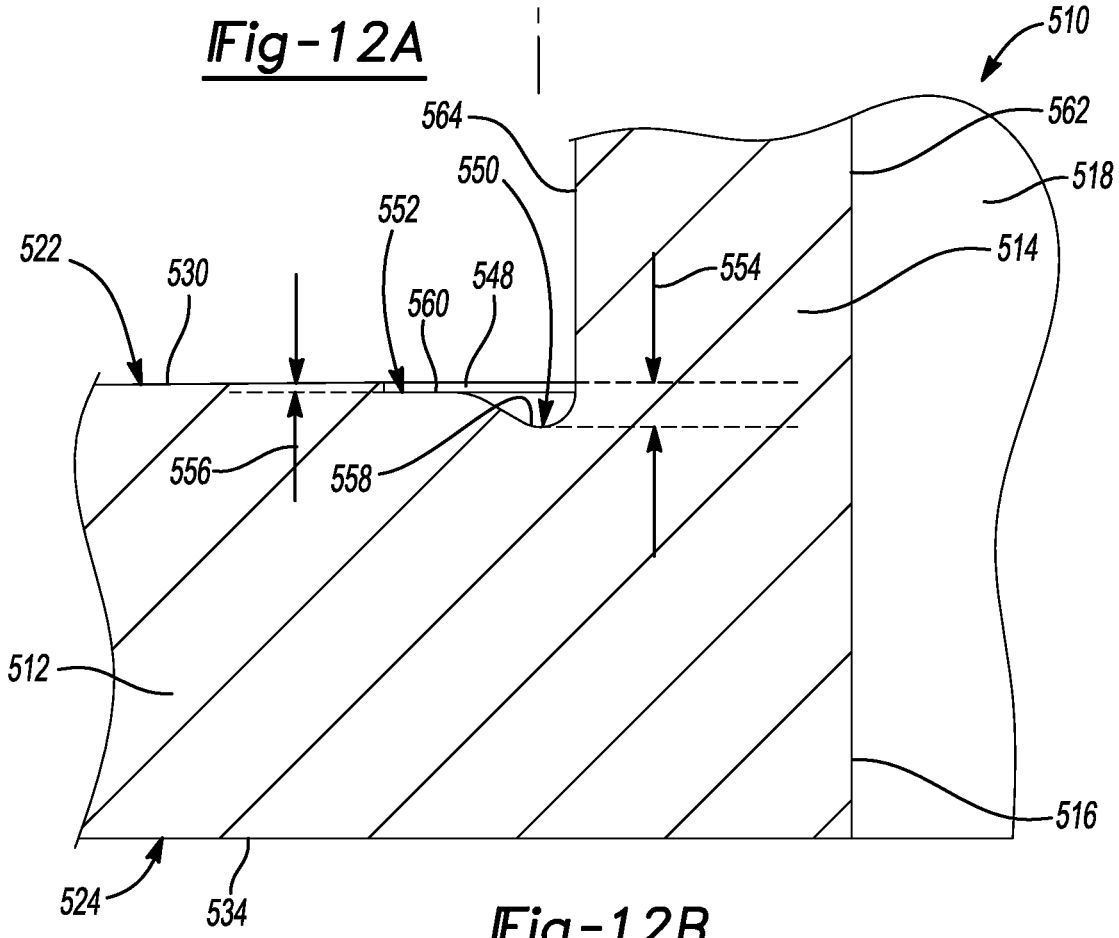
Figure 12C:
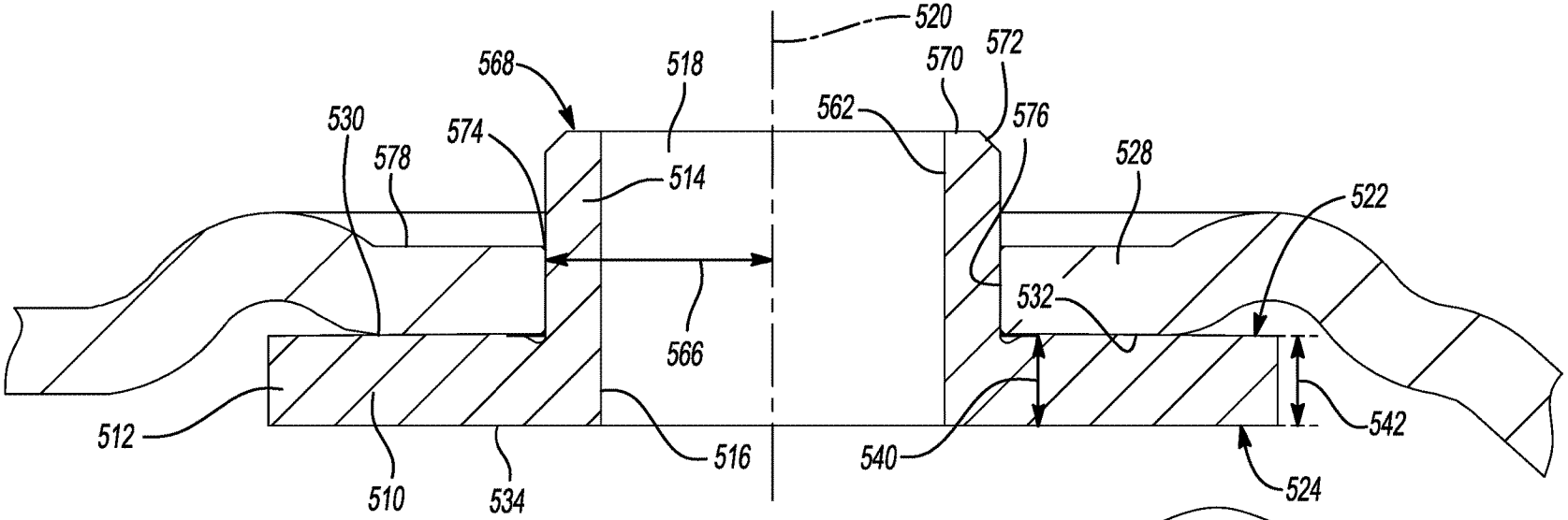
Figure 12D:
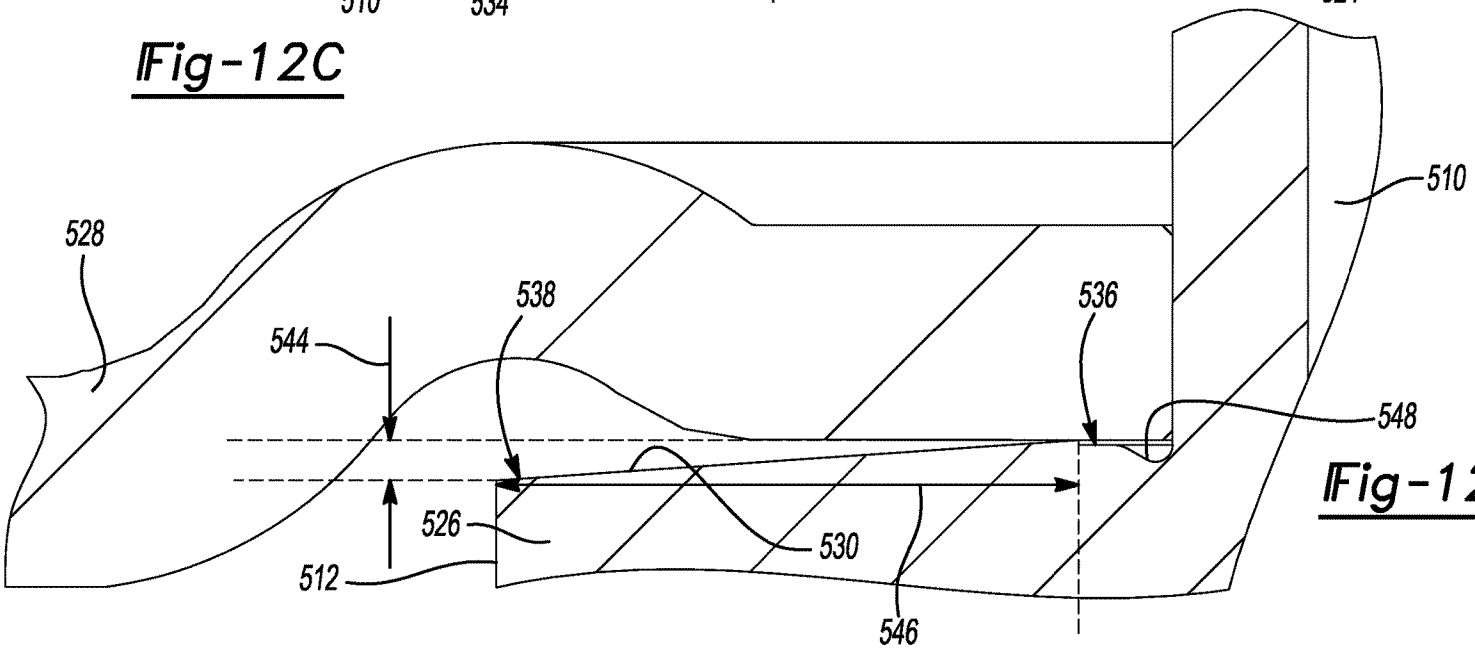

FIGS. 4A-4C show a polymeric composite insert component according to certain aspects of the present disclosure. FIG. 4A shows a top isometric view of the polymeric composite insert component; FIG. 4B shows a bottom isometric view of the polymeric composite insert component; FIG. 4C shows a partial sectional view taken at line 4C-4C of FIG. 4A;

FIGS. 5A-5B show a scroll compressor having a polymeric composite insert component according to certain aspects of the present disclosure. FIG. 5A is a partial sectional view of the scroll compressor; FIG. 5B is an isometric section view of the polymeric composite insert component;

FIGS. 6A-6B show the polymeric composite insert component of FIGS. 5A-5B. FIG. 6A is a top view of the polymeric composite insert component; FIG. 6B is a bottom view of the polymeric composite insert component;

FIG. 7 is a partial sectional view of the polymeric composite insert component and partition plate of FIGS. 5A-5B;

FIG. 8 is a partial sectional view of another polymeric composite insert component according to certain aspects of the present disclosure, the polymeric composite insert component being fixed to a partition plate;

FIGS. 9A-9B show another polymeric composite insert component according to certain aspects of the present disclosure. FIG. 9A is a top isometric view of the polymeric composite insert component; FIG. 9B is a side view of the polymeric composite insert component taken at line 9B-9B of FIG. 9A;

FIGS. 10A-10B show yet another polymeric composite insert component according to certain aspects of the present disclosure. FIG. 10A is a top isometric view; FIG. 10B is a sectional view taken at line 10B-10B of FIG. 10A;

FIGS. 11A-11C show yet another polymeric composite insert component according to certain aspects of the present disclosure. FIG. 11A is a top isometric view; FIG. 11B is a sectional view taken at line 11B-11B of FIG. 11A; and FIG. 11C is a sectional view taken at line 11C-11C of FIG. 11A; and FIGS. 12A-12D show yet another polymeric composite insert component according to certain aspects of the present disclosure. FIG. 12A is a top isometric view; FIG. 12B is a partial sectional view; FIG. 12C is a sectional view showing the polymeric composite insert component and a partition plate; and FIG. 12D is a partial sectional view.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range, including endpoints given for the ranges.

In various aspects, the present teachings provide a polymeric composite insert component for sealing an interface between a floating seal assembly and a partition (e.g., a partition plate, a muffler plate, or a shell) in a compressor, such as a scroll compressor. In certain variations, this disclosure provides a polymeric insert component that can be coupled to the partition or the floating seal assembly. In certain aspects, the polymeric insert component comprises a polymer, such as a thermoplastic polymer. In certain aspects, the polymeric insert component comprises a composite material including a polymer and at least one reinforcement material distributed within the polymer. Such a thermoplastic composite provides greater ability to conform to the partition and the floating seal assembly to enhance sealability and seal performance. For example, a thermoplastic composite in the polymeric composite insert component can provide high strength, while enhancing flexibility and elasticity at the interface. More particularly, the polymeric composite insert component conforms to the partition and the floating seal assembly during operation of the compressor, including during deformation of the partition at high loads. Thus, the polymeric composite insert component may increase overall compressor efficiency.

Figure 1:
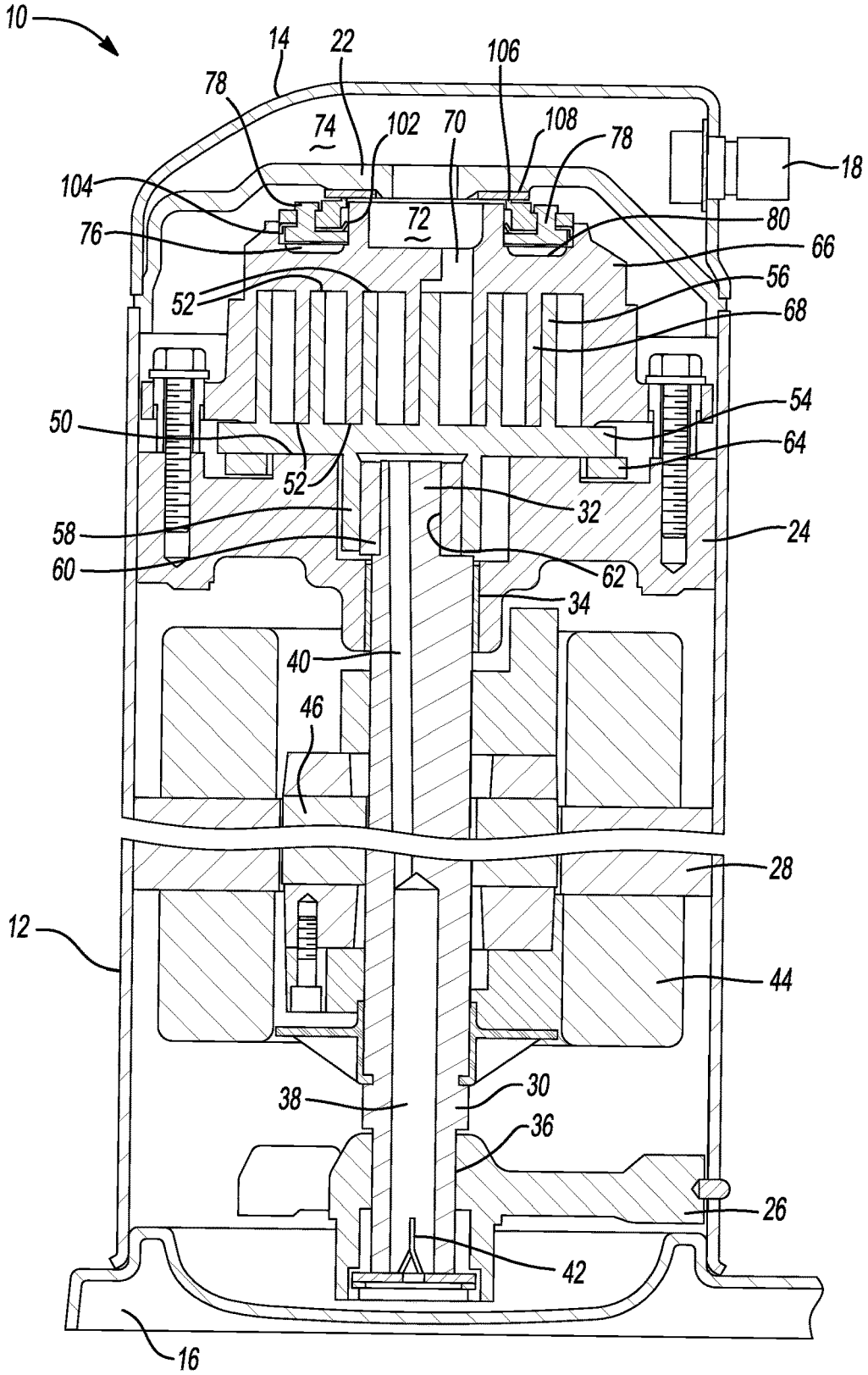
Fig-1 PRIOR ART
FIG. 1 is a sectional view through a center of a scroll compressor having a conventional design.

By way of background, a conventional hermetic refrigerant scroll compressor 10 is described in the context of FIG. 1. The scroll compressor 10 comprises a generally cylindrical hermetic shell 12 having welded at the upper end thereof a cap 14 and at the lower end thereof a base 16. The cap 14 is provided with a refrigerant discharge fitting 18 which may have the usual discharge valve componentry therein (not shown). Other major elements affixed to the shell 12 include a transversely extending partition, which is shown here as a partition plate 22, which is connected about its periphery along the same joint that cap 14 is attached to shell 12. A stationary main bearing housing or body 24 is suitably secured to shell 12, and a lower bearing housing 26 also having a plurality of radially-outwardly extending legs, each of which is also suitably secured to shell 12. A motor stator 28 is disposed within shell 12. Flats between the rounded corners on the motor stator 28 provide passageways between the stator 28 and shell 12, which facilitate the flow of lubricant from the top of the shell 12 to the bottom.

A drive shaft or crankshaft 30 having an eccentric crank pin 32 at the upper end thereof is rotatably journaled in a bearing 34 in the main bearing housing 24 and a second bearing 36 in the lower bearing housing 26. Crankshaft 30 has at the lower end a relatively large diameter concentric bore 38 which communicates with a radially-outwardly-inclined smaller diameter bore 40 extending upwardly therefrom to the top of the crankshaft. Disposed within bore 38 is a stirrer 42. The lower portion of the interior shell 12 is filled with lubricating oil, and the bore 38 serves to pump lubricating fluid up the crankshaft 30 and into the bore 40, and ultimately to all of the various portions of the compressor which require lubrication. The crankshaft 30 is rotatively driven by an electric motor including stator 28, windings 44 passing therethrough, and a rotor 46 press-fitted on the crankshaft 30.

An upper surface of main bearing housing 24 is provided with a flat thrust bearing surface 50 on which is disposed an orbiting scroll member 54 defining the usual spiral vane or involute portion 56. Projecting downwardly from the lower surface of orbiting scroll member 54 is a cylindrical hub 58 having a journal bearing therein and in which is rotatively disposed a drive bushing 60 having an inner bore 62 in which crank pin 32 is drivingly disposed. The crank pin 32 has a flat on one surface which drivingly engages a flat surface (not shown) formed in a portion of bore 62 to provide a radially-compliant driving arrangement. An Oldham coupling 64 is positioned between and keyed to orbiting scroll member 54 and a non-orbiting scroll member 66 to prevent rotational movement of orbiting scroll member 54.

The non-orbiting scroll member 66 is also provided having a non-orbiting involute portion 68 positioned in meshing engagement with orbiting involute portion 56 of orbiting scroll member 54. The non-orbiting scroll member 66 has a centrally-disposed discharge passage 70 communicating with an upwardly-open recess 72 which is in fluid communication with a discharge muffler chamber 74 defined by the cap 14 and the partition plate 22 through an opening defined by the partition plate 22. It should be noted that while the exemplary design only shows the partition plate 22, which can serve as a muffler plate, a variety of conventional known designs can alternatively be attached to the shell 12 or partition, including an assembly of plates or components or an external shell/housing.

Thus, the orbiting involute portion 56 and non-orbiting involute portion 68 (of the two scroll members 54, 66) are arranged together with the scroll involute portions 56, 68 being rotationally displaced 180° from one another. The scroll compressor 10 operates by orbiting the involute portion 56 of orbiting scroll member 54 with respect to the other involute portion 68 of stationary non-orbiting scroll member 66, thus making moving line contacts between the flanks of the respective involute portions 56, 68, thus defining moving isolated crescent-shaped pockets of fluid. The moving fluid pockets carry the fluid to be handled from a first zone in the scroll machine where a fluid inlet is provided, to a second zone in the machine where a fluid outlet is provided. The volume of a sealed pocket changes as it moves from the first zone to the second zone. At any one instant in time there will be at least one pair of sealed pockets; and where there are several pairs of sealed pockets at one time, each pair will have different volumes. In the compressor 10, the second zone is at a higher pressure than the first zone and is physically located centrally in the compressor 10, the first zone being located at the outer periphery of the compressor 10.

Two types of contacts define the fluid pockets formed between the scroll members 54, 66: (1) axially extending tangential line contacts between the spiral faces or flanks of the involute portions 56, 68 caused by radial forces ("flank sealing"), and (2) area contacts caused by axial forces between the plane edge surfaces defined by terminal edges or tips 52 of each involute portion 56, 68 and the opposite end plate ("tip sealing"). For high efficiency, optimizing sealing for both types of contacts is important.

One of the difficult areas of design in a scroll-type machine concerns the technique used to achieve tip sealing under all operating conditions, and also at all speeds in a variable speed machine. Conventionally, this has been accomplished by (1) using extremely accurate and very expensive machining techniques, (2) providing the involute portion tips 52 with spiral tip seals, which are difficult to assemble and often unreliable, or (3) applying an axially restoring force by axial biasing the orbiting scroll member 54 or the non-orbiting scroll member 66 towards the opposing scroll using compressed working fluid.

The utilization of an axial restoring force typically entails one of the two scroll members 54, 66 being mounted for axial movement with respect to the other scroll member. This can be accomplished by securing the non-orbiting scroll member 66 to a main bearing housing 24. Second, a biasing load applied to the axially movable non-orbiting scroll member 66 urges the non-orbiting scroll member 66 into engagement with the orbiting scroll member 54. This can be accomplished by forming a chamber 76 on the side of the non-orbiting scroll member 66 opposite to the orbiting scroll member 54, placing a floating seal assembly 78 in the chamber 76 and then supplying a pressurized fluid to this chamber 76. The source of the pressurized fluid can be the scroll compressor itself. Thus, an annular recess 80 can be formed in non-orbiting scroll member 66, within which is disposed the floating seal assembly 78. The recesses 72 and 80 and floating seal assembly 78 cooperate to define axial pressure biasing chambers which receive pressurized fluid being compressed by involute portions 56 and 68, so as to exert an axial biasing force on non-orbiting scroll member 66 to thereby urge the tips 52 of respective involute portions 56, 68 into sealing engagement with the opposed end plate surfaces.

Figure 2:
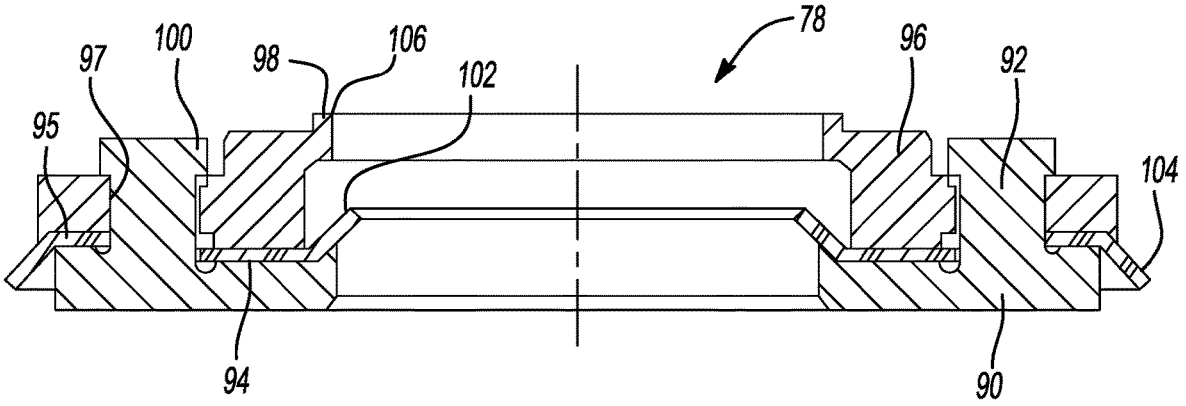
Fig-2 PRIOR ART
FIG. 2 is a partial sectional view showing a floating seal assembly as in FIG. 1.
Figure 3:
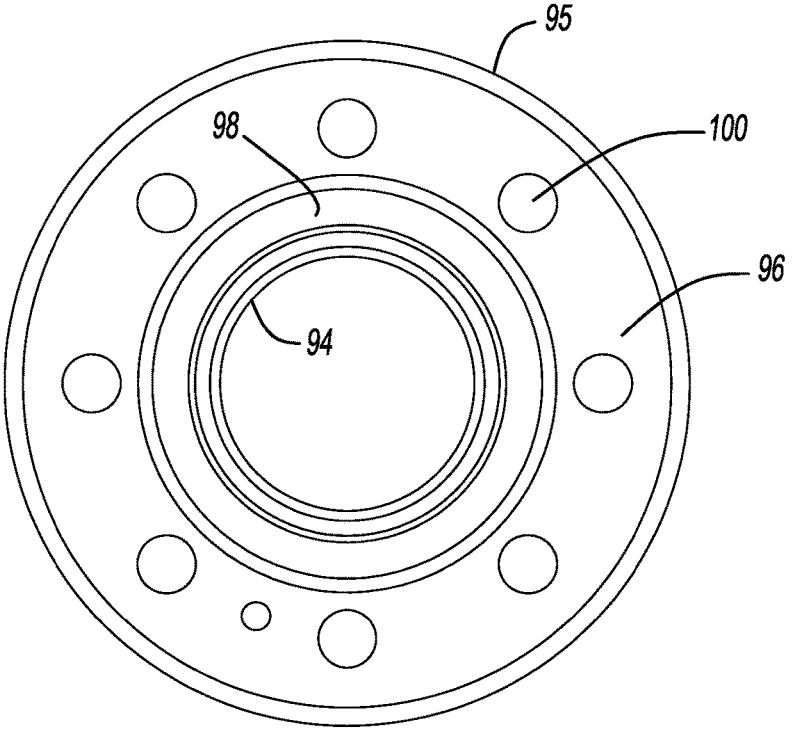
Fig-3 PRIOR ART
FIG. 3 is a plan view showing an upper seal plate forming a portion of the floating seal assembly as in FIG. 1.

With reference to FIGS. 1-3, a conventional floating seal assembly 78 is shown which has a coaxial sandwiched construction that comprises an annular base plate or lower seal plate 90 conventionally formed out of a metal, such as cast iron or aluminum. Such floating seal assemblies 78 generally function as a valve to enable or prevent flow of high-pressure refrigerant gas from a high-pressure discharge area to the low-pressure suction/inlet area in the compressor 10. At normal operating conditions for the compressor 10, the valve is closed and a face seal minimizes bypass of gas from a discharge side to an inlet/suction side. The valve will, however, open in response to a high discharge-to-suction pressure ratio in the compressor 10 to prevent system failure.

Thus, in the design shown in FIGS. 1-3, the annular base plate 90 has a plurality of equally-spaced upstanding integral projections or posts 92. Disposed on base plate 90 is an annular inner gasket or seal 94 and an annular outer gasket or seal 95. On top of seals 94, 95 is disposed an annular upper seal plate 96 having a plurality of equally-spaced holes 97 receiving projections 92. Upper annular seal plate 96, which is conventionally formed of a metal, such as grey cast iron, has disposed about the periphery thereof an upwardly projecting planar seal lip that defines a sealing lip or face seal 98. The floating seal assembly 78 is secured together by swaging the ends of each projection 92 as indicated at 100.

The overall seal assembly 78 therefore provides three distinct seals, namely, an inside diameter seal at 102, an outside diameter seal at 104 and a top or face seal at 106. Seal 102 isolates fluid under intermediate pressure in the bottom of recess 80 from fluid under discharge pressure in recess 72. Seal 104 isolates fluid under intermediate pressure in the bottom of recess 80 from fluid at suction pressure within shell 12. Seal 106 isolates fluid at suction pressure within shell 12 from fluid at discharge pressure in recess 72 across the top of floating seal assembly 78. FIG. 1 illustrates a wear ring 108 attached to partition plate 22 (that in alternative embodiments which are not shown, could be attached to a separate partition plate attached to shell 12 or partition), which provides seal 106 between face seal 98 (of plate 96) and wear ring 108. In lieu of wear ring 108, the lower surface of partition plate 22 can be locally hardened by nitriding, carbo-nitriding or other hardening processes known in the art to form the partition plate 22 against which the face seal 98 can interface.

The diameter of seal 106 is chosen so that there is a positive upward sealing force on floating seal assembly 78 under normal operating conditions, at normal pressure ratios. Therefore, when excessive pressure ratios are encountered, the floating seal assembly 78 will be forced downwardly by discharge pressure, thereby permitting a leak of high side discharge pressure gas directly across the top of floating seal assembly 78 to a zone of low side suction gas. If this leakage is great enough, the resultant loss of flow of motor cooling suction gas (aggravated by the excessive temperature of the leaking discharge gas) will cause a motor protector (not shown) to trip, thereby de-energizing the motor. The width of seal 106 is chosen so that the unit pressure on the seal itself (e.g., between face seal 98 and wear ring 108) is greater than normally encountered discharge pressure, to promote consistent sealing. The discharge pressure of compressor 10 urges the inner lip seal portion of seal 94 into engagement with non-orbiting scroll member 66 to form the inside diameter seal at 102.

Thus, conventional floating seals, like floating seal assembly 78, can be an assembly of two metal plates and one or more polymer sealing rings. The lower seal plate 90 is often formed of as-cast aluminum (or other metals) including the vertical posts 92 that fit through holes or openings 100 in the upper seal plate 96. Upper seal plate 96 is often formed of cast iron (or other metals). The upper seal plate 96 has the face seal 98 feature incorporated into its top surface that interacts with a partition plate 22 (e.g., muffler plate) to form seal 106 whenever the two components are in contact. The polymer seals 94, 95 are located by and held between the two seal plates 90, 96. The assembly process for conventional seal assemblies involves stacking the pieces together and then plastically deforming the aluminum posts 92 such that the top ends locally spread out over the lower seal plate 90 to form a rigid and secure attachment.

When assembled, the one or more polymer seals 94, 95 are retained by the two seal plates 90, 96 in a first plane and the sealing interface with the non-orbiting scroll member 66 occurs along a surface of the non-orbiting scroll member 66 that is generally perpendicular to the plane of retention by the two plates 90, 96. Thus, the one or more polymer seals 94, 95 bend through an approximately 90° angle to achieve their sealing.

In various aspects, the present teachings provide a polymeric composite insert component for improved sealing between a partition and a floating seal assembly in a compressor, such as a scroll compressor. The polymeric composite insert component is disposed between the partition and the floating seal assembly. The polymeric composite insert component may be formed of a composite that includes a polymer and a reinforcement or lubricating phase. The polymeric composite insert component may provide a fluid seal at a first interface between the partition and the polymeric composite insert component and at a second interface between the polymeric composite insert component and the floating seal assembly. The polymeric construction enables the insert component to conform to the partition and the floating seal assembly more effectively than the metal-to-metal joint of the compressor described in FIGS. 1-3, particularly during operation of the compressor.

Operation of the compressor, especially at high loads, may cause the partition to deform. Such deformation may act on the component(s) engaging the partition to create respective areas of high pressure and low pressure on the component. In the example described in FIGS. 1-3, the deformed partition 22 acts on the floating seal assembly 78 to create respective high and low pressure areas on a top surface of the partition 22. The metal interface surfaces of the partition 22 and the floating seal assembly 78 may be too inflexible to provide a continuous interface and fluidic seal when the partition deforms. The resulting imperfect seal may create leak paths and lead to a lower overall compressor efficiency.

In various aspects, the polymeric composite insert component according to the teachings of the present disclosure may be relatively elastic. Thus, it can form a more compliant interface and an improved seal compared to a metal-to-metal interface. In certain embodiments, a first contact surface of the polymeric composite insert component that engages the partition may be provided with a waveform shape that compliments the deformation of the partition to create a relatively uniform contact pressure and further improve sealing at the first and the second interfaces. In certain other embodiments, the first contact surface of the polymeric composite insert component may be provided with a circumferential protrusion, such as a circumferential barrel, to increase pressure at the first and the second interfaces. In yet other embodiments, the first contact surface may define and slope that is positive in a radially-inward direction to increase pressure on the partition plate, thereby decreasing deformation of the partition plate.

The polymer resin of the polymeric composite insert component may be further provided with a reinforcement or lubricating phase (e.g., reinforcing or lubricating filler particles or fibers) that forms a polymeric composite, which is particularly advantageous for use as a part of a seal component in a scroll member, such as the polymeric composite insert component. A "composite" can refer to a material which includes a polymer resin or matrix having a plurality of reinforcing or lubricating particles distributed throughout as a reinforcement phase. Composite polymer matrices provide additional strength and structural integrity, while providing superior wear resistance for use as a seal material.

In various aspects, suitable polymers include a thermoplastic resin, which provides a heat-resistant matrix for at least one or more distinct reinforcing or lubricating particles to form the composite that forms the insert component. Suitable thermoplastic polymers can be selected from the polyaryletherketone (PAEK) family. In certain variations, the polyaryletherketone (PAEK) thermoplastic polymer can be selected from the group consisting of: polyetherketone (PEK), polyetheretherketone (PEEK), polyetheretheretherketone (PEEEK), polyetherketoneketone (PEKK), polyetheretherketoneketone (PEEKK) polyetherketoneetheretherketone (PEKEEK), and polyetheretherketoneetherketone (PEEKEK) and combinations thereof. In other variations, the thermoplastic matrix material may comprise polyamide imide (PAI), polyphenylene sulfide (PPS), polyimide (PI), polyphthalamide (PPA), or polyether imide (PEI) alone or as combined with any of the other suitable thermoplastic polymers discussed just above. In certain variations, the thermoplastic polymer is selected from the group consisting of: a polyaryl ether ketone (PAEK) or other ultra-performing polymer including, but not limited to poly (phenylene sulphide) (PPS), poly(sulphone) (PS), polyamide imide (PAI), or polyimide (PI). In certain variations, a particularly desirable carrier material or thermoplastic polymer is an ultra-performance, high temperature thermoplastic resin, such as a member of the polyaryl ether ketone (PAEK) family like polyetheretherketone (PEEK). In various aspects, the polymer includes a thermoset resin. Suitable thermoset resins include epoxy, polyester, phenolic, and imides, such as polyamide imide (PAI) and polyimide (PI) (which may be formulated as thermoplastic or thermoset).

Reinforcing or lubricating particles for the composite material of the insert component may include inorganic materials, metals, or high performance polymeric materials (particles or fibers). The reinforcing particles or fillers can be any number of anti-friction/anti-wear compounds including, but not limited to inorganic fillers, organic fillers, and polymeric particles used as fillers. Thus a solid material in particulate form (e.g., a plurality of solid particles) that contributes to a low coefficient of friction or provides additional tribological or synergistic properties to the overall anti-wear material composition, while reinforcing the resin in the composite, is particularly desirable. In various aspects, the composite material of the insert component includes at least one reinforcing or lubricating particle. In certain variations, a suitable composite for the insert component comprises a first reinforcing or lubricating particle and a second reinforcing or lubricating particle distinct from the first reinforcing or lubricating particle. In yet other variations, the composite for the insert component may comprise three or more distinct reinforcing and/or lubricating particles.

In certain variations, the composite of the insert component comprises a plurality of reinforcing particles that are distinct from one another. In certain variations, the insert component comprises at least one reinforcing or lubricating particle selected from the group consisting of: polytetrafluoroethylene (PTFE), molybdenum disulfide ($MoS_2$), tungsten disulfide ($WS_2$), antimony trioxide, hexagonal boron nitride, carbon fiber, graphite, graphene, lanthanum fluoride, carbon nanotubes, polyimide particles (or powderized polyimide polymer), polybenzimidazole (PBI) particles, and combinations thereof. In certain embodiments, a first reinforcing particle and a second reinforcing particle distinct from the first reinforcing particle can be independently selected from the group consisting of: polytetrafluoroethylene (PTFE) particles (or powderized PTFE), molybdenum disulfide ($MoS_2$) particles, tungsten disulfide ($WS_2$), antimony trioxide, hexagonal boron nitride particles, carbon fibers, graphite particles, graphene particles, lanthanum fluoride, carbon nanotubes, polyimide particles (or powderized polyimide polymer), polybenzimidazole (PBI) particles (e.g., fibers), and combinations thereof. In certain preferred variations, three distinct reinforcing or lubricating particles are independently selected from the group consisting of: poly(tetrafluoroethylene) (PTFE), graphite, carbon fiber, antimony trioxide, carbon nanotubes, polyimide, and combinations thereof. In certain variations, a first reinforcing or lubricating particle comprises poly(tetrafluoroethylene) (PTFE) particles, while a second reinforcing or lubricating particle comprises graphite, and a third reinforcing or lubricating particle comprises carbon fiber.

Referring to FIGS. 4A-4C, one embodiment of a polymeric composite insert component 200 according to certain aspects of the present disclosure is shown. A polymeric composite insert component 200 includes an annular body 202 and at least one axial projection. The axial projection comprises a plurality of circumferentially-disposed tabs 204. The circumferentially-disposed tabs 204 project from the annular body 202. The annular body 202 has an annular inner surface 206 that defines a centrally-disposed opening 208. A central axis 210 extends longitudinally through the centrally-disposed opening 208. The annular body 202 includes a first side 212 and a second side 214 opposite the first side 212.

The annular body 202 includes an annular outer surface 216. The first side 212 of the annular body 202 includes a tab surface 218 and a first contact surface 220. The first contact surface 220 is disposed in a radially outward position from the tab surface 218. The first contact surface 220 may be substantially planar. The second side 214 includes a second contact surface 222. The second contact surface 222 may be substantially planar. The second contact surface 222 may be disposed substantially parallel to the first contact surface 220 such that the first and the second contact surfaces 220, 222 are substantially perpendicular to the central axis 210. The tab surface 218 has a first height 224 with respect to the second contact surface 222 in an axial direction parallel to the central axis 210. The first contact surface 220 has a second height 226 with respect to the second contact surface 222 in the axial direction. Although the first height 224 is shown as less than the second height 226 in FIG. 4A, in various other embodiments, the first and the second heights 224, 226 may be equal or the second height 226 may be greater than the first height 224. The annular body 202 should have a minimum thickness to provide a sufficient seal. The minimum thickness may be dependent upon load, contact pressure, and stress.

The tabs 204 are circumferentially-disposed about the central axis 210. Thus, each of the respective tabs 204 may be disposed at an equal distance from the central axis 210 and spaced at a pre-determined distance around the tab surface 218 of annular body 202. The tabs 204 project from the tab surface 218 and extend along a tab axis 228 that is substantially parallel to the central axis 210. Each tab 204 has a fixed end 230 and a free end 232. The fixed end 230 joins the tab 204 to the annular body 202. The free end 232 can be radially-inwardly flexed toward the central axis 210. As will be discussed in greater detail in other embodiments, the tabs 204 may be flexed radially inwardly when the polymeric composite insert component 200 is assembled to a partition of a scroll compressor.

Each tab 204 may include an arm 234 and a lip 236. The arm 234 extends between the fixed end 230 and the free end 232. The lip 236 is disposed at the free end 232 and extends radially outwardly from the arm 234. As best shown in FIG. 4C, the arm 234 has an arc-shaped cross section in a transverse plane perpendicular to the tab axis 228. Thus, a radially-inward arm surface 238 and a radially-outward arm surface 240 are each curved. The radially-inward arm surface 238 may be continuous with the annular inner surface 206.

The lip 236 may include a third contact surface 242 that extends radially outwardly from the radially-outward arm surface 240. The third contact surface 242 may be substantially perpendicular to the radially-outward arm surface 240. A sloped surface 244 extends from the third contact surface 242, radially inwardly toward the free end 232 of the arm 234. An upper lip surface 246 extends between the sloped surface 244 and the radially-inward arm surface 238. In various alternative aspects, a tab may be provided without a lip (not shown).

The polymeric composite insert component 200 as shown includes three tabs 204. However, in other variations, the quantity of tabs 204 may be less than three or greater than three. For example, the quantity of tabs 204 may be one (see, e.g., axial projection 514 of FIGS. 12A-12D), two, four, or five (not shown). In certain embodiments, the tabs 204 may occupy greater than or equal to about 10% and less than or equal to about 100% of a total circumference of the centrally-disposed opening 208, optionally greater than or equal to about 20% and less than or equal to about 85%, optionally greater than or equal to about 20% and less than or equal to about 80%, optionally greater than or equal to about 20% and less than or equal to about 75%, optionally greater than or equal to about 20% and less than or equal to about 70%, optionally greater than or equal to about 20% and less than or equal to about 65%, optionally greater than or equal to about 20% and less than or equal to about 60%, optionally greater than or equal to about 20% and less than or equal to about 55%, optionally greater than or equal to about 20% and less than or equal to about 50%, optionally greater than or equal to about 25% and less than or equal to about 45%, optionally greater than or equal to about 30% and less than or equal to about 40%, optionally greater than or equal to about 32% and less than or equal to about 38%, optionally greater than or equal to about 34% and less than or equal to about 36%, and optionally about 35%. Each of the tabs 204 may be equally spaced about the central axis 210. Thus, the tab axes 228 may be disposed about 120° from one another. However, in other embodiments, the tabs 204 may be unevenly spaced about the central axis 210 (not shown).

With reference to FIGS. 5A-7, a portion of a scroll compressor 260 is shown. The scroll compressor 260 includes a partition plate 262 and a floating seal assembly 264 that may be similar to the partition plate 22 and floating seal assembly 78 of the compressor 10 of FIG. 1. The scroll compressor 260 further includes a polymeric composite insert component 266 that is coupled to the partition plate 262 and engages the floating seal assembly 264. Although the polymeric composite insert component 266 is shown as being disposed between the partition plate 262 and the floating seal assembly 264, in other embodiments, the polymeric composite insert component 266 may be disposed between the partition plate 262 and a non-orbiting scroll (see e.g., non-orbiting scroll 66 of FIG. 1). Various components of the floating seal assembly 264 are the same as those shown in FIGS. 1-3. For brevity, floating seal assembly components previously discussed in the context of FIGS. 1-3 will not be reintroduced in subsequent discussion of the figures, unless pertinent to the features discussed herein.

The polymeric composite insert component 266 includes an annular body 268 and circumferentially-disposed tabs 270 similar to the annular body 202 and circumferentially-disposed tabs 204 of FIGS. 4A-4C. The annular body 268 includes a first annular inner surface 272, a first centrally-disposed opening 274 (FIG. 5B), and a central axis 276 similar to the annular inner surface 206, centrally-disposed opening 208, and central axis 210 of FIGS. 4A-4C. The annular body 268 further includes a first side 278 disposed toward the partition plate 262 and a second side 280 disposed toward the floating seal assembly 264. A first contact surface 282 of the first side 278 is defined by a circumferential barrel 284 and engages the partition plate 262. A second contact surface 286 is substantially planar and engages the face seal 98 of the floating seal assembly 264.

Each of the circumferentially-disposed tabs 270 includes a tab axis 288, a fixed end 290, a free end 292, an arm 294, and a lip 296 similar to the tab axis 228, fixed end 230, free end 232, arm 234, and lip 236 of the polymeric composite insert component 200 of FIGS. 4A-4C. Each arm 294 includes a radially-outward arm surface 298 similar to the radially-outward arm surface 240 of the polymeric composite insert component 200 of FIGS. 4A-4C. Each lip 296 includes a third contact surface 300 and an upper lip surface 302 similar to the third contact surface 242 and upper lip surface 246 of the polymeric composite insert component of FIGS. 4A-4C.

The partition plate 262 includes a second annular inner surface 304 defining a second centrally-disposed opening 306 (FIG. 5B). The first and second centrally-disposed openings 274, 306 are coaxial such that they are both aligned with the central axis 276. The partition plate 262 further includes a top surface 308 and a bottom surface 310 opposite the top surface 308. The top surface 308 is oriented toward a discharge muffler chamber (see, e.g., discharge muffler chamber 74 of FIG. 1) and the bottom surface 310 is oriented toward the polymeric composite insert component 266.

The first contact surface 282 of the annular body 268 of the polymeric composite insert component 266 at least partially engages the bottom surface 310 of the partition plate 262. The circumferentially-disposed tabs 270 project through the second centrally-disposed opening 306 of the partition plate 262. The radially-outward arm surface 298 at least partially engages the second annular inner surface 304 of the partition plate 262. The lips 296 of the circumferentially-disposed tabs 270 extend radially outwardly to engage an inner diameter 312 of the top surface 308 of the partition plate 262. More specifically, the third contact surfaces 300 of the lips 296 engage the top surface 308 of the partition plate 262 to retain the polymeric composite insert component 266 on the partition plate 262. While the polymeric composite insert component 266 is shown as being fixed to the partition plate 262, a person of ordinary skill in the art would understand that it could alternatively be fixed to the floating seal assembly 264. In such an embodiment, the circumferentially-disposed tabs 270 of the polymeric composite insert component 266 would project through a third centrally-disposed opening 313 (FIG. 5B) of the floating seal assembly 264 to couple the polymeric composite insert component 266 to the floating seal assembly 264 in a similar manner as described above with respect to the partition plate 262.

In various aspects, the present teachings provide a method of attaching the polymeric composite insert component 266 to the partition plate 262. The polymeric composite insert component 266 is brought to a bottom side 314 of the partition plate 262 so that the first side 278 of the polymeric composite insert component 266 is orientated toward the bottom surface 310 of the partition plate 262. The central axis 276 of the polymeric composite insert component 266 is aligned with the second centrally-disposed opening 306 of the partition plate 262. The polymeric composite insert component 266 is translated toward the partition plate 262 in an upward direction 316 substantially parallel to the central axis 276. The upper lip surfaces 302 of the tabs 270 engage the partition plate 262 to deflect the tabs 270 radially inwardly toward one another and toward the central axis 270. The lips 296 slide along the second annular inner surface 304 of the partition plate 262 until they clear the second centrally-disposed opening 306 of the partition plate 262. The lips 296 then snap radially outwardly so that the radially-outward arm surface 298 engages the second annular inner surface 304 and the third contact surface 300 engages the top surface 308 of the partition plate 262.

Although the first contact surface 282 and the third contact surface 300 are both shown as being in contact with the partition plate 262, in other embodiments, the simultaneous contact of both the first contact surface 282 and the third contact surface 300 with the partition plate 262 is unnecessary. In one example, the circumferentially-spaced tabs 204 of polymeric composite insert component 266 may omit the lip 236 altogether. This configuration is possible because of a relatively small clearance between the floating seal assembly 264 and the partition plate 262. In this configuration, the arms 294 may be long enough to cover the relatively small clearance.

When the compressor 260 is in operation, the partition plate 262 may become deformed, particularly under high loads. Some deformation of the partition plate 262 may also occur when the compressor is not in operation (e.g., due to the cold rolling manufacturing process used to form the partition plate, press fit of the partition plate 262 to the shell 12 or the cap 14, or welding the partition plate 262 to the shell 12). Deflection of the partition plate 262 may cause a non-uniform pressure distribution at a first interface 318 defined between the bottom surface 310 of the partition plate 262 and the first contact surface 282 of the polymeric composite insert component 266. The non-uniform pressure distribution at the first interface 318 leads to a corresponding non-uniform pressure distribution at a second interface 320 defined between the second contact surface 286 of the polymeric composite insert component 266 and the face seal 98 of the floating seal assembly 264. The non-uniform pressure distributions at the first interface 318 and the second interface 320 can result in non-contact areas at the interfaces 318, 320, thereby creating leak paths and reducing overall compressor efficiency.

In one example, the partition plate 262 may include one or more lower stiffness regions 322. The lower stiffness region 322 may be a relatively flat lobe for mounting a pressure relief valve and a temperature relief valve (not shown), by way of non-limiting example. The lower stiffness region 322 deflects in a downward direction 324 parallel to the central axis 276 and opposite the upward direction 316. Downward deflection of the partition plate 262 creates relatively a high pressure region at the first interface 318 at the circumferential position of the lower stiffness region 322. Another higher pressure region may be present at a circumferential position opposite the lower stiffness region 322 (i.e., about 180° from the lower stiffness region 322 with respect to the central axis 276). The deflection of the partition plate 262 may also create corresponding lower pressure regions that are disposed between the higher pressure regions (e.g., about 90° from each the higher pressure regions, when there are two higher pressure regions). The higher pressure regions and lower pressure regions may be present at both the first interface 318 and the second interface 320.

In the present example, the deflection of the partition plate 262 may create a relatively high pressure region at a first circumferential location 326 on the polymeric composite insert component 266. The first circumferential location 326 may be axially aligned with the lower stiffness region 322 of the partition plate 262. Another higher pressure region is present at a second circumferential location 328 opposite the first circumferential location 326. Thus, the second circumferential location 328 is disposed about 180° from the first circumferential location 326 with respect to the central axis 276. A third circumferential location 330 may be circumferentially disposed between the first location 326 and the second location 328 and a fourth circumferential location 332 may be circumferentially disposed between the first location 326 and the second location 328. The third circumferential location 330 may be disposed equidistant or about 90° between the first circumferential location 326 the second circumferential location 328. The fourth circumferential location 332 may be disposed equidistant or about 90° between the first circumferential location 326 and the second circumferential location 328. Thus, the fourth circumferential location 332 may be disposed opposite the third circumferential location 330 or about 180° from the third circumferential location 330. A person skilled in the art would understand that the principles of this disclosure apply equally regardless of the circumferential location of the deflection or the quantity of high and low pressure regions. Thus, the polymeric composite insert component 266 may be capable of providing a fluid seal between the partition plate 262 and the floating seal assembly 264 independent of the design and resulting deflection of the partition plate 262.

Inward deflection of the partition plate 262 at the second annular inner surface 306 may also cause decreased contact between the top surface 308 of the partition plate 262 and the third contact surface 300 of the lips 296. With reference to FIG. 7, the tab 270 is shown engaging the partition plate 262. A plane 334 is disposed perpendicular to the central axis 276. A tab angle 336 is defined between the plane 334 and the radially-outward arm surface 298. The tab angle 336 may be about 90°.

Referring now to FIG. 8, in other embodiments, another tab angle 340 may be defined between a plane 342 and a radially-outward arm surface 344, similar to the plane 334 and radially-outward arm surface 298 of FIG. 7. The tab angle 340 may be less than about 90°, optionally greater than or equal to about 75° and less than about 90°, optionally greater than or equal to about 80° and less than about 90°, optionally greater than or equal to about 81° and less than about 90°, optionally greater than or equal to about 82° and less than about 90°, optionally greater than or equal to about 83° and less than about 90°, optionally greater than or equal to about 84° and less than about 90°, optionally greater than or equal to about 85° and less than about 90°, optionally greater than or equal to about 86° and less than about 90°, optionally greater than or equal to about 87° and less than about 90°, and optionally greater than or equal to about 88° and less than about 90°. Thus, the tab angle 340 may provide an undercut that creates a gap 345. The gap 345 may accommodate radially-inward deflection of a partition plate 346. Thus, a third contact surface 347 of a tab 348 of a polymeric composite insert component 350 may remain in contact with a top surface 352 of the partition plate 346 during radially-inward deflection of the partition plate 346.

Referring now to FIGS. 9A-9B, another polymeric composite insert component 360 is shown. The polymeric composite insert component 360 includes an annular body 362 and at least one axial projection comprising a plurality of circumferentially-disposed tabs 364 extending therefrom. The annular body 362 has an annular inner surface 366 defining a centrally-disposed opening 368. A central axis 370 extends through the centrally-disposed opening 368. The annular body 362 has a first side 372 and a second side 374 opposite the first side 372. The first side 372 includes a first contact surface 376 and the second side 374 includes a second contact surface 378.

The circumferentially-disposed tabs 364 may be similar to the circumferentially-disposed tabs 270 of FIGS. 5A-7. The annular body 362 includes a plurality of circumferentially-disposed openings 380. The circumferentially-disposed openings 380 are disposed adjacent to and in a radially outward position from the respective plurality of circumferentially-disposed tabs 364. The openings 380 may decrease a stiffness of the tabs 364 at a fixed end 382 to enable the tabs 364 to more readily flex radially inwardly when the polymeric composite insert component 360 is assembled to a partition or a floating seal assembly.

The first contact surface 376 defines a circumferential waveform shape defining at least two valleys 384 and at least two peaks 386. The valleys 384 may be defined at a first circumferential location 388 and a second circumferential location 390. The peaks 386 may be defined at a third circumferential location 392 and a fourth circumferential location 394. The valleys 384 and peaks 386 may be defined in an axial direction parallel to the central axis 370 to complement axial deflection of a partition plate. For example, the partition plate may deflect axially downwardly at the first circumferential location 388 and the second circumferential location 390 and axially upwardly at the third circumferential location 392 and the fourth circumferential location 394. Thus, a magnitude of pressure difference between higher pressure areas and lower pressure areas may be minimized. In some embodiments, pressure at the first contact surface 376 may be relatively uniform under normal operating conditions.

The second contact surface 378 may be relatively planar. The second contact surface 378 may be substantially perpendicular to the central axis 370. The first circumferential location 388 and the second circumferential location 390 may have a first thickness 396 with respect to the second contact surface 378. The third circumferential location 392 and the fourth circumferential location 394 may have a second thickness 398. The second thickness 398 may be greater than the first thickness 396. In some embodiments, a difference between the second thickness 398 and the first thickness 396 may be greater than about 0 mm and less than or equal to about 0.2 mm, optionally greater than or equal to about 0.01 mm and less than or equal to about 0.19 mm, optionally greater than or equal to about 0.02 mm and less than or to about 0.18 mm, optionally greater than or equal to about 0.03 mm and less than or to about 0.17 mm, optionally greater than or equal to about 0.04 mm and less than or to about 0.16 mm, optionally greater than or equal to about 0.05 mm and less than or to about 0.15 mm, optionally greater than or equal to about 0.06 mm and less than or to about 0.14 mm, optionally greater than or equal to about 0.07 mm and less than or to about 0.13 mm, optionally greater than or equal to about 0.08 mm and less than or to about 0.12 mm, optionally greater than or equal to about 0.09 mm and less than or to about 0.11 mm, and optionally about 0.1 mm.

The first circumferential location 388 may be disposed opposite the second circumferential location 390. Thus, the first circumferential 388 location may be disposed 180° from the second circumferential location 390. The third circumferential location 392 and the fourth circumferential location 394 may be disposed circumferentially between the first circumferential location 388 and the second circumferential location 390. The third circumferential 392 location may be disposed between the first circumferential location 388 and the second circumferential location 390, about 90° from each of the first circumferential location 388 and the second circumferential location 390. The fourth circumferential 394 location may be disposed between the first circumferential location 388 and the second circumferential location 390, about 90° from each of the first circumferential location 388 and the second circumferential location 390. The third circumferential location 392 is disposed opposite the fourth circumferential location 394. Thus, the third circumferential 394 location is disposed 180° from the fourth circumferential location 394.

The polymeric composite insert component 360 may further include an anti-rotation feature (not shown). The anti-rotation feature may prevent the polymeric composite insert component from rotating about the central axis 370 with respect to the partition plate. By way of non-limiting example, the anti-rotation feature may include a hole, notch, slot, or other receptacle that engages a protrusion in the partition plate. Alternatively, the protrusion may be present on the polymeric composite insert component 360 and the receptacle may be present on the partition plate.

In other embodiments, the first side 422 may include different geometry to complement and conform to expected deflection of the partition plate. In one example, the first side 422 may have other quantities of alternating peaks and valleys, such as three peaks and three valleys, four peaks and four valleys, or ten peaks and ten valleys. In another example, the first side 422 may a sloped surface having a single high point (i.e., a single peak). In yet another example, the first side 422 may have a single discrete hump or protrusion that does not extend circumferentially around the entire first side 422.

In still other embodiments, the second side 424 may be non-planar. For example, the second side 424 may have geometry to complement and conform to expected deflection of the floating seal assembly. In one example, the second side 424 may include a circumferential waveform shape having alternating peaks and valleys, similar to the peaks 386 and valleys 384 of the first side 422 shown in FIGS. 9A-9B. In another example, the second side 424 may have a discrete high point or low point.

Referring to FIGS. 10A-10B, yet another polymeric composite insert component 410 is shown. The polymeric composite insert component 410 includes an annular body 412 and a plurality of circumferentially-disposed tabs 414 extending therefrom. The annular body 412 has an annular inner surface 416 defining a centrally-disposed opening 418. A central axis 420 extends through the centrally-disposed opening 418. The annular body 412 has a first side 422 and a second side 424 opposite the first side 422. The first side 422 includes a first contact surface 426 and the second side 424 includes a second contact surface 428. The circumferentially-disposed tabs 414 may be similar to the circumferentially-disposed tabs 270 of FIGS. 5A-7. The annular body 412 includes a plurality of circumferentially-disposed openings 430 similar to the circumferentially-disposed openings 380 of FIGS. 9A-9B.

The first contact surface 426 may define a circumferential protrusion 432. The circumferential protrusion 432 may be disposed in a radially outward position from the circumferentially-disposed tabs 414. The circumferential protrusion 432 may be hump or barrel-shaped. The circumferential protrusion 432 may increase average pressure between the polymeric composite insert component 410 and a partition plate by decreasing average contact area. The increased pressure reduces leak paths to provide a better fluid seal.

In some embodiments, the first contact surface 426 may include more than one circumferential protrusions 432. For example, the first contact surface 426 may include a first circumferential protrusion and a second circumferential protrusion disposed in a radially outward position from the first circumferential protrusion. Thus, a circumferential void space may be disposed between the first circumferential protrusion and the second circumferential protrusion. The inclusion of multiple circumferential protrusions may further improve the fluid seal.

With reference to FIGS. 11A-11C, yet another polymeric composite insert component 440 is shown. The polymeric composite insert component 440 includes an annular body 442 and at least one axial projection including a plurality of circumferentially-disposed tabs 444. The annular body 442 may be similar to the annular body 268 of FIGS. 5A-7. Thus, the annular body 442 may include an annular inner surface 446 defining a centrally-disposed opening 448.

Each of the circumferentially-disposed tabs 444 includes a fixed end 450 and a free end 452. The circumferentially-disposed tab 444 includes a circumferential connector 454 disposed at the fixed end 450, an arm 456 extending between the fixed end 450 and the free end 452, and a circumferentially extending lip 458 disposed at the free end 452. The tab 444 is connected to the annular inner surface 446 of the annular body 442 by the circumferential connector 454.

The free ends 452 of the tabs 444 can flex radially inwardly when the polymeric composite insert component 440 is assembled to a partition plate or a floating seal assembly. The tabs 444 have a rectangular cross section at a transverse plane perpendicular to a central axis 460 of the annular body 442. The tabs 444 having a rectangular cross section have a lower stiffness than the tabs 204 of FIGS. 4A-4C, which have arc-shaped cross sections. Thus, the tabs 444 having a rectangular cross section exhibit less resistance to flexing radially inwardly during assembly to the partition plate or the floating seal assembly. Furthermore, a flex axis for the tabs 444 fixed to the annular inner surface 446 is lower compared to the tabs 204 fixed to the tab surface 218 of FIGS. 4A-4C. Thus, the tabs 444 have a longer lever arm than the tabs 204 and can therefore be radially-inwardly flexed with less effort.

Referring to FIGS. 12A-12D, yet another polymeric composite insert component 510 according to certain aspects of the present disclosure is shown. The polymeric composite insert component 510 includes an annular body 512 and an axial projection 514 projecting therefrom. The annular body 512 has an annular inner surface 516 (FIG. 12B) that defines a first centrally-disposed opening 518. A central axis 520 extends longitudinally through the first centrally-disposed opening 518. The annular body 512 includes a first side 522 and a second side 524 opposite the first side 522. The annular body 512 further includes an annular outer surface 526.

The polymeric composite insert component 510 may be configured to be disposed between a partition plate 528 (FIG. 12C) and a floating seal assembly (not shown). The polymeric insert component 510 may be configured to translate along the central axis 520 with respect to the partition plate 528. Accordingly, in various aspects, deformation of the partition plate 528 may cause the polymeric insert component 510 to translate rather than deform. The partition plate 528 may be similar to the partition plate 22 of FIG. 1. The floating seal assembly may be similar to the floating seal assembly 78 of FIG. 1.

The first side 522 of the polymeric composite insert component 510 may include a first contact surface 530. The first contact surface 530 may be configured to engage a first or bottom surface 532 of the partition plate 528. The second side 524 of the polymeric composite insert component 510 may include a second contact surface 534. The second contact surface 534 may be configured to engage the floating seal assembly. Accordingly, the polymeric composite insert component 510 is configured to fluidly seal both a first interface defined between the first contact surface 530 and the partition plate 528, and a second interface defined between the second contact surface 534 and the floating seal assembly during operation of a scroll compressor. The second contact surface 534 may extend substantially perpendicular to the central axis 520.

The first contact surface 530 may define a slope between a first radial location 536 and a second radial location 538. In various aspects, the first radial location 536 defines a circle having a substantially constant first radius and the second radial location 538 defines a circle having a substantially constant second radius. The second radial location 538 may be disposed radially outside of the first radial location 536 (e.g., the second radius may be greater than the first radius). In various aspects, the first contact surface 530 may be substantially symmetric about the central axis 520. In certain aspects, the slope may be referred to as a radial slope. The first contact surface 530 may form an oblique angle with respect to the central axis 520.

As best shown in FIG. 12C, the annular body 512 may define a first body height 540 substantially parallel to the central axis 520 at the first radial location 536. The annular body 512 may define a second body height 542 substantially parallel to the central axis 520 at the second radial location 538. The first body height 540 may be greater than the second body height 542. Accordingly, the slope may be positive from the second radial location 538 to the first radial location 536. In various aspects, the slope may be linear such that a height of the annular body 512 increases at a substantially constant rate between the second radial location 538 and the first radial location 536. By way of non-limiting example, the linear slope may be greater than or equal to about 0.001 to less than or equal to about 0.016, optionally greater than or equal to about 0.003 to less than or equal to about 0.01, and optionally greater than or equal to about 0.003 to less than or equal to about 0.009. In various alternative aspects, the slope may be non-linear and/or negative from the second radial location 538 to the first radial location 536 (not shown)

As best shown in FIG. 12D, the slope may define a slope height 544 substantially parallel to the central axis 520. The slope height 544 may be greater than or equal to about 0.01 mm to less than or equal to about 0.15 mm, optionally greater than or equal to about 0.02 to less than or equal to about 0.07 mm, and optionally greater than or equal to about 0.03 mm to less than or equal to about 0.07 mm. In one example, the slope height is about 0.03 mm. In another example, the slope height is about 0.07 mm. The slope may define a slope length 546 substantially perpendicular to the central axis 520. The slope length 546 may be greater than or equal to about 2 mm to less than or equal to about 15 mm, optionally greater than or equal to about 5 mm to less than or equal to about 12 mm, and optionally greater than or equal to about 8 mm to less than or equal to about 9 mm.

The first contact surface 530 may define an annular groove 548. The annular groove 548 may be disposed radially between the axial projection 514 and the first radial location 536. The annular groove 548 may contribute to both fluidic sealing performance and ease of manufacturing of the polymeric composite insert component 510. A size and shape of the annular groove 548 may be modified to optimize sealing performance and/or ease of manufacturing. In various alternative aspects, the annular groove 548 may be omitted (not shown).

Referring to FIG. 12B, the annular groove 548 may comprise a first or inner portion 550 and a second or outer portion 552. The first portion 550 may be disposed radially inward of the second portion 552. The first and second portions 550, 552 may be directly adjacent to one another. The first portion 550 may define a first maximum depth 554 substantially parallel to the central axis 520. The second portion 552 may define a second maximum depth 556 substantially parallel to the central axis 520. The first and second maximum depths 554, 556 may be distinct. In various aspects, the first maximum depth 554 may be greater than the second maximum depth 556. In one example, the first portion 550 may include a substantially rounded surface 558 and the second portion 552 may include a substantially flat surface 560. In various alternative aspects, a first maximum depth of an inner portion of a groove may be less than a second maximum depth of an outer portion of the groove.

The axial projection 514 may extend from the first side 522 of the annular body 512. However, in various alternative aspects, an axial projection may extend from a second side, or both the second side and a first side (not shown). The axial projection 514 may extend around at least a portion of an inner diameter of the annular body 512. The axial projection 514 may be disposed radially inward of the first contact surface 530. The at least a portion of the inner diameter may be greater than or equal to about 10%, optionally greater than or equal to about 20%, optionally greater than or equal to about 30%, optionally greater than or equal to about 40%, optionally greater than or equal to about 50%, optionally greater than or equal to about 60%, optionally greater than or equal to about 70%, optionally greater than or equal to about 80%, optionally greater than or equal to about 90%, optionally greater than or equal to about 95%, and optionally about 100%. Thus, the axial projection 514 may extend along substantially the entire inner diameter, as best shown in FIG. 12A. Accordingly, the axial projection 514 may define a substantially annular shape. The substantially annular shape may increase a stiffness of the polymeric composite insert component 510 compared to an insert component having a plurality of circumferentially-disposed tabs (see, e.g., insert components 266, 360, 410, 440).

The axial projection 514 may include an inner projection surface 562 and an outer projection surface 564. The inner and outer surfaces 562, 564 may be concentrically disposed about the central axis 520. The inner projection surface 562 may be directly adjacent to the annular inner surface 516 of the annular body 516. The axial projection 514 may have a substantially constant outer diameter 566 (FIG. 12C). However, in various alternative embodiments, an axial projection may have a diameter that varies along the central axis 520, such as a diameter that tapers from largest adjacent to the annular body 512 and smallest at a distal end. The axial projection 514 may include a distal end 568 defining an upper projection surface 570. An annular chamfer 572 may extend between the upper projection surface 570 and the outer projection surface 564. In various aspects, the annular chamfer 572 may be omitted.

As best shown in FIG. 12C, when the polymeric composite insert component 510 is assembled to the partition plate 528, the axial projection 514 extends through a second centrally-disposed opening 574 of the partition plate 528. The outer projection surface 564 of the polymeric composite insert component 510 may engage an inner partition plate surface 576. In various alternative aspects, the outer projection surface 564 and the inner partition plate surface 576 may be spaced apart to define a gap (not shown). The first contact surface 530 of the polymeric composite insert component 510 may engage the bottom surface 532 of the partition plate 528. The distal end 568 of the axial projection 514 may extend past the partition plate 528. More particularly, the distal end 568 of the axial projection 514 may extend past a second or top surface 578 of the partition plate 528, the top surface 578 of the partition plate 528 being disposed opposite the bottom surface 532. Thus, if the polymeric composite insert component 510 translates along the central axis 520 during operation of the compressor, it may nonetheless remain retained by the partition plate 528.

One skilled in the art will appreciate that features of the above polymeric composite insert components 200, 266, 350, 360, 410, 440, 510 may be combined. In one example, the circumferentially-spaced tabs 204, 270, 364, 414, 444 are combined with the sloped first contact surface 530. In another example, the axial projection 514 is combined with the first contact surface 376 defining valleys 384 and peaks 386.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A polymeric composite insert component for a scroll compressor comprising a polymer and at least one reinforcing or lubricating particle, the polymeric composite insert component comprising:

an annular body comprising a first annular inner surface defining a first centrally-disposed opening that has a central axis extending therethrough, the annular body having a first side and a second side opposite the first side, the first side comprising a first contact surface configured to engage a partition plate and the second side comprising a second contact surface configured to engage a floating seal assembly, the first contact surface defining a slope between a first radial location and a second radial location; and an axial projection extending from the annular body, the axial projection being configured to be received in a second centrally-disposed opening of the partition plate, wherein the polymeric composite insert component is configured to fluidly seal both a first interface defined between the first contact surface and the partition plate, and a second interface defined between the second contact surface and the floating seal assembly during operation of the scroll compressor.

2. The polymeric composite insert component of claim 1, wherein:

the second radial location is disposed radially outside of the first radial location; and the slope is positive from the second radial location to the first radial location.

3. The polymeric composite insert component of claim 1, wherein the polymeric composite insert component is substantially symmetric about the central axis.

4. The polymeric composite insert component of claim 1, wherein the slope is linear.

5. The polymeric composite insert component of claim 4, wherein the slope is greater than or equal to about 0.001 to less than or equal to about 0.016.

6. The polymeric composite insert component of claim 1, wherein the slope defines a height substantially parallel to the central axis, the height being greater than or equal to about 0.01 mm to less than or equal to about 0.15 mm.

7. The polymeric composite insert component of claim 1, wherein the slope defines a length substantially perpendicular to the central axis, the length being greater than or equal to about 5 mm to less than or equal to about 12 mm.

8. The polymeric composite insert component of claim 1, wherein the second contact surface extends substantially perpendicular to the central axis.

9. The polymeric composite insert component of claim 1, wherein the first contact surface defines an annular groove, the annular groove being disposed radially between the axial projection and the first radial location.

10. The polymeric composite insert component of claim 9, wherein:

the annular groove comprises a first portion and a second portion, the first portion being disposed radially inward of the second portion; and the first portion defines a first maximum depth substantially parallel to the central axis and the second portion defines a second maximum depth substantially parallel to the central axis, the second maximum depth being distinct from the first maximum depth.

11. The polymeric composite insert component of claim 10, wherein the first maximum depth is greater than the second maximum depth.

12. The polymeric composite insert component of claim 1, wherein the axial projection extends around at least a portion of an inner diameter of the annular body.

13. The polymeric composite insert component of claim 12, wherein the axial projection extends along substantially an entire inner diameter of the annular body.

14. The polymeric composite insert component of claim 1, wherein the axial projection defines an annular shape.

15. The polymeric composite insert component of claim 1, wherein a distal end of the axial projection extends past a second partition plate surface, the second partition plate surface being disposed opposite the first partition plate surface.

16. The polymeric composite insert component of claim 1, wherein the axial projection defines a plurality of circumferentially-disposed tabs.

17. The polymeric composite insert component of claim 16, wherein the plurality of circumferentially-disposed tabs comprises three circumferentially disposed tabs.

18. The polymeric composite insert component of claim 16, wherein the plurality of circumferentially-disposed tabs is substantially equally spaced about the central axis.

19. The polymeric composite insert component of claim 1, wherein:

the polymer is a thermoplastic polymer selected from the group consisting of: polyaryletherketone (PAEK), polyetherketone (PEK), polyetheretherketone (PEEK), polyetheretheretherketone (PEEEK), polyetherketoneketone (PEKK), polyetheretherketoneketone (PEEKK) polyetherketoneetheretherketone (PEKEEK), polyetheretherketonetherketone (PEEKEK), poly(phenylene sulphide) (PPS), poly(sulphone) (PS), polyamide imide (PAI), polyimide (PI), polyphthalamide (PPA), polyetherimide (PEI), and combinations thereof; and the at least one reinforcing or lubricating particle is selected from the group consisting of: polytetrafluoroethylene (PTFE), molybdenum disulfide ($MoS_2$), tungsten disulfide ($WS_2$), antimony trioxide, hexagonal boron nitride, carbon fiber, graphite, graphene, lanthanum fluoride, carbon nanotubes, polyimide, polybenzimidazole (PBI), and combinations thereof.

20. The polymeric composite insert component of claim 1, wherein the polymeric composite insert component is configured to translate along the central axis with respect to the partition plate.

* * * * *